US007163732B2

(12) United States Patent
Hirasawa et al.

(10) Patent No.: US 7,163,732 B2
(45) Date of Patent: Jan. 16, 2007

(54) THIN SANITARY PAPER ROLL METHOD OF MANUFACTURING THE PAPER ROLL, AND THIN SANITARY PAPER FOR THIN SANITARY PAPER ROLL

(75) Inventors: Akira Hirasawa, Shizuoka (JP); Takeharu Mukai, Saitama (JP)

(73) Assignee: Daio Paper Corporation, Ehime (JP)

( * ) Notice: Subject to any disclaimer, the term of this patent is extended or adjusted under 35 U.S.C. 154(b) by 143 days.

(21) Appl. No.: 10/479,120

(22) PCT Filed: May 24, 2002

(86) PCT No.: PCT/JP02/05076

§ 371 (c)(1),
(2), (4) Date: May 28, 2004

(87) PCT Pub. No.: WO02/096256

PCT Pub. Date: Dec. 5, 2002

(65) Prior Publication Data

US 2004/0234805 A1 Nov. 25, 2004

(30) Foreign Application Priority Data

May 28, 2001 (JP) ..... 2001-159089
Aug. 28, 2001 (JP) ..... 2001-257522
Aug. 31, 2001 (JP) ..... 2001-264535

(51) Int. Cl.
*B32B 5/14* (2006.01)

(52) U.S. Cl. ..... 428/170; 428/171; 252/90; 252/92; 252/91; 252/94; 427/242

(58) Field of Classification Search ..... 428/170, 428/171; 252/90, 92, 91, 94; 427/242
See application file for complete search history.

(56) References Cited

U.S. PATENT DOCUMENTS 4,735,738 A * 4/1988 Willman ..... 510/330
6,030,690 A * 2/2000 McNeil et al. ..... 428/156
6,884,492 B1 * 4/2005 Basler et al. ..... 428/172

FOREIGN PATENT DOCUMENTS

JP 55-26922 2/1980
JP 62-162080 7/1987
JP 06-154123 6/1994
JP 07-268800 10/1995
JP 10-077595 3/1998
JP 11-093055 4/1999
JP 3071054 7/2000

OTHER PUBLICATIONS

"Decision of Final Rejection" issued Dec. 7, 2004 in Japanese Patent Application No. 2001-257522 (in English and Japanese languages).

* cited by examiner

*Primary Examiner*—Ieszek B. Kiliman
(74) *Attorney, Agent, or Firm*—Wenderoth, Lind & Ponack, L.L.P.

(57) ABSTRACT

Disclosed is a sanitary tissue paper roll wherein, when a sanitary tissue paper roll of two-ply or three-ply is laid on a horizontal surface with its central axis in a horizontal orientation, and a circular plate indenter, having an area of 2 $cm^2$ and being arranged at a center of an upper surface of an outer periphery of a body of the roll, is vertically pressed at least at respective pressing pressures of 0.5 $gf/cm^2$ and 50 $gf/cm^2$, a difference in depths upon this respective pressing is within a range of 2.5–3.5 mm. Also disclosed is a sanitary tissue paper roll made by winding one sheet or two layered sheets of sanitary tissue papers wherein a roll compressibility of the roll is 0.68–0.74 $m/cm^2$, with the roll compressibility being defined as a value obtained by dividing a roll length by a cross section of the roll. Also disclosed is a sanitary tissue paper for a sanitary tissue paper roll, wherein a sample paper is compressed between steel plates, which respectively have a circular surface with a compression area of 2 $cm^2$, at a maximum compression load of 50 $gf/cm^2$, and upon returning of this paper sample, a linearity of a displacement curve between a load and a thickness is 0.2500–0.3300 for a one-ply, and 0.3400–0.3700 for a two-ply; and a thickness upon a load of 50 $gf/cm^2$ is equal to at least 0.1400 mm for a one-ply, and equal to at least 0.2500 mm for a two-ply.

20 Claims, 8 Drawing Sheets

THIN SANITARY PAPER ROLL METHOD OF MANUFACTURING THE PAPER ROLL, AND THIN SANITARY PAPER FOR THIN SANITARY PAPER ROLL

TECHNICAL FIELD

The present invention relates to a sanitary tissue paper roll such as a toilet paper roll, a method of making the same, and a sanitary tissue paper for a sanitary tissue paper roll.

BACKGROUND ART

Toilet paper rolls (also called toilet rolls), as sanitary tissue paper rolls, are generally made by winding one sheet to three layers of sheets of sanitary tissue papers onto a paper core and into a roll (though there are products without paper cores). Usually, a roll made by winding one sheet of sanitary tissue paper is called one-ply, a roll made by winding two-layered sheets of sanitary tissue papers is called a two-ply, and a roll made by winding three-layered sheets of sanitary tissue papers is called a three-ply.

Particularly, in a case of toilet paper rolls made of 100% natural pulp, embossing is applied to the sanitary tissue paper to provide a thickness feeling and bulk softness. In a toilet paper roll made of such pulp, usually, about 60 m of sanitary tissue paper for one-ply, and about 30 m for two-ply, is wound onto a paper core having an inner diameter of 45 mm and a thickness of 0.5 mm, and made into a roll having about an 110 mm outer diameter. Recently, there are rolls called compact rolls in which 90 m for one-ply and 45 m for two-ply is wound around a paper core having an outer diameter of about 38 mm.

In such toilet paper rolls, since the toilet paper comes directly into contact with sensitive skin, rigorousness in quality is required from a consumer. That is, these products are always exposed to a consumer's rigorous selection, and thus, there are several high hurdles to be overcome in order for these products to be used.

A first hurdle is to provide a good image upon purchasing so that the product will be tried once. A second hurdle is not to disappoint the above-mentioned image, i.e., a consumer's expectations, upon actual usage.

(A) Object of Toilet Paper Roll in Order to Overcome the First Hurdle

Toilet paper rolls are usually displayed and sold in stores in packages wherein a plurality of toilet paper rolls are packed. It is thought that a consumer decides whether or not to purchase the rolls by holding the toilet paper roll in his/her hand, and by unconsciously imagining a feeling of the toilet paper upon use, based on the feeling upon holding.

Through this fact, the present applicant found that the feeling upon holding the toilet paper roll, that is, hardness felt upon holding the roll, becomes a potential purchasing index for deciding whether or not to purchase the roll. It is thought that purchasing is decided based on the thought that, for example, if the toilet paper roll feels hard upon holding the roll, the paper may be hard and uncomfortable upon usage in the form of a sheet in an unwound actual usage state, or, if the roll is too soft, the paper may rip upon usage because it is too soft also in the form of a sheet.

However, roll hardness of toilet paper rolls currently put on the market does not possess a suitable tender-touch. Thus, it is inferred that there are many cases where the rolls are losing an opportunity of being tried.

(B) Object Upon Giving the Toilet Paper Roll a Suitable Roll Hardness

On the other hand, in order to provide the roll hardness with a suitable tender-touch, there are the following objects. That is, conventional sanitary tissue paper rolls were either wound too hard and had poor thickness feeling or bulk softness, or on the contrary, wound too loose and the rolls easily deformed in a telescopic manner in which a central portion projects from sides, or their section deformed into a polygonal shape, and was poor in massiveness when holding in a hand.

Particularly, in a case where the roll was wound hard, although it is thought that by applying the above-mentioned embossing, the thickness feeling and bulk softness can be improved, only by providing clear embosses, an emboss is stretched and flattened and the thickness feeling and bulk softness are lost upon winding or as time passes due to tension in a winding direction. Further, in case of forming a compact roll, since sanitary tissue paper is wound around a core while being tensioned, an emboss is stretched and flattened due to this tension. Thus, it is not possible to enhance a thickness feeling and bulk softness.

On the other hand, if the paper is softly wound merely by lowering tension upon winding, windings tend to easily loosen. This not only becomes a cause of defectively wound items and deteriorates massiveness, but also causes a problem in that a roll diameter becomes too large even though a roll length is short. Particularly, if winding is performed with a usual roll length after providing clear embosses to increase paper thickness, even though flattening of the embosses can be prevented, the roll diameter becomes too large and the rolls cannot be held by usual holders.

(C) Object of Sanitary Tissue Paper for Toilet Paper Roll in Order to Overcome the Second Hurdle Upon unwinding and actually using the toilet paper roll having been purchased mainly by image as explained above, it is necessary not to give an impression to a consumer, who purchased the roll, that he has been betrayed of his/her expectations. Further, upon use, the consumer will sensually evaluate, for example, a tender-touch, pliantness, bulk softness, hardness, and smoothness of the roll in a state of a sanitary tissue paper having been unwound from the toilet paper roll.

Therefore, conventionally, in addition to paper-quality data such as grammage, paper thickness, strength, and elongation which are generally-measured physical properties of paper, it has been typical for a manufacturer to adopt indexes such as "softness" or "MMD" as evaluation criteria corresponding to such sensory evaluation.

"Softness" shows a resistance value (average value in longitudinal and lateral directions) when pushing a paper, being 10 cm wide, into a 5.0 mm gap using a terminal. "MMD" shows a variation (average deviation) in a friction coefficient between paper and a contactor wound with a piano wire. These are measuring methods used generally for sanitary papers.

However, "softness" is affected by friction between the paper and the terminal, and does not always sufficiently correspond to tender-touch and/or pliantness evaluated by a person. Further, although "MMD" has a relationship with smoothness felt by skin, this resulting value has not been able to show a difference between a mere slippery feeling and smoothness.

Therefore, it has not been able to sufficiently grasp bulk softness, pliantness, tender-touch and/or smoothness to the touch, which are required for toilet papers, and thus, it was not possible to reproduce quality nor confirm that quality has been reproduced.

Only by paper-quality data, softness and MMD, a delicate quality felt by a person was not sufficiently grasped, nor was it possible to sufficiently conduct an absolute evaluation in a time series or a differential analysis compared with competitive products made by other companies.

SUMMARY OF THE INVENTION

In view of the above and other matters, one aspect of a sanitary tissue paper roll of the present invention is, for example, such wherein, when a sanitary tissue paper roll of two-ply or three-ply is laid on a horizontal surface with its central axis in a horizontal orientation, and a circular plate indenter, having an area of 2 $cm^2$ and being arranged at a center of an upper surface of an outer periphery of a body of the roll, is vertically pressed at least at respective pressing pressures of 0.5 $gf/cm^2$ and 50 $gf/cm^2$, a difference in depths upon this respective pressing is within a range of 2.5–3.5 mm.

Another aspect of the sanitary tissue paper roll of the present invention is, for example, such wherein, when a sanitary tissue paper roll of one-ply is laid on a horizontal surface with its central axis in a horizontal orientation, and a circular plate indenter, having an area of 2 $cm^2$ and being arranged at a center of an upper surface of an outer periphery of a body of the roll, is vertically pressed at least at respective pressing pressures of 0.5 $gf/cm^2$ and 50 $gf/cm^2$, a difference in depths upon this respective pressing is within a range of 1.5–2.5 mm.

Note that various other aspects may be contrived regarding the present invention.

DETAILED DESCRIPTION OF THE PREFERRED EMBODIMENTS

Figure 1:
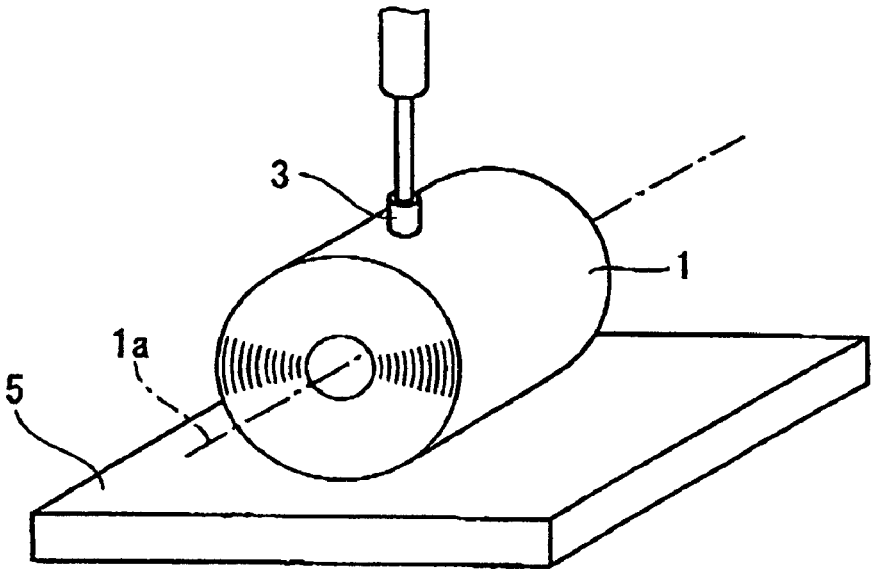
FIG. 1 is a perspective view showing a method of measuring roll hardness of a toilet paper roll according to the present invention.

The present invention was construed to solve the above and other problems, and a first object is to provide a sanitary tissue paper roll which can give an appropriate tender-touch feeling when a consumer takes the roll in his/her hand.

A second object is to provide a sanitary tissue paper roll which is rich in thickness feeling and bulk softness while being difficult to deform, which has a sufficient massiveness when taken in the hand, and in which an emboss is not easily flattened in case embossing is applied.

Further, a third object is to provide a sanitary tissue paper for a sanitary tissue paper roll which is superior and matches human sensory evaluation, and which is highly valued in terms of such sensory evaluation. Other objects are to permit quantification of bulk softness, pliantness and smoothness of a sanitary tissue paper, and to permit management and control of quality of this toilet paper according to measurement data, by using a combination of two measurement data for respective three basic measurement methods, or by using the three basic measurement methods and six measurement data.

In order to achieve the above and other objects, the sanitary tissue paper roll according to one aspect of the present invention is such wherein, when a sanitary tissue paper roll of two-ply or three-ply is laid on a horizontal surface with its central axis in a horizontal orientation; and a circular plate indenter, having an area of 2 $cm^2$ and being arranged at a center of an upper surface of an outer periphery of a body of the roll, is vertically pressed at least at respective pressing pressures of 0.5 $gf/cm^2$ and 50 $gf/cm^2$, a difference in depths upon this respective pressing is within a range of 2.5–3.5 mm.

According to the structure above, when a consumer takes a two-ply or three-ply sanitary tissue paper roll in his/her hand, the consumer can feel an appropriate tender-touch. This is because a difference in pressing depth of the present sanitary tissue paper roll is set within an appropriate range of 2.5–3.5 mm based on a correlation between a sensory-evaluation value of roll hardness, which is felt by a person taking the sanitary tissue paper roll in his/her hand, and the above-mentioned difference in pressing depth, in order to provide an appropriate soft feeling to a person holding the roll. That is, since the difference in pressing depth is set to be equal to at least 2.5 mm, the consumer is not given a feeling that the roll is too hard; whereas, since the above-mentioned difference in pressing depth is set equal to at least 3.5 mm, he is not given a feeling that the roll is too soft. Therefore, the consumer can feel an appropriate tender-touch.

Further, it is possible to objectively and quantitatively evaluate a sensory-evaluation value, which expresses roll hardness felt by a person, as a difference in pressing depth upon pressing a circular plate indenter into the roll at two pressing pressures. Therefore, it is possible to control the roll hardness of a sanitary tissue paper roll within an appropriate range.

A sanitary tissue paper roll according to one aspect of the present invention is such wherein, when a sanitary tissue paper roll of one-ply is laid on a horizontal surface with its central axis in a horizontal orientation, and a circular plate indenter, having an area of 2 $cm^2$ and being arranged at a center of an upper surface of an outer periphery of a body of the roll, is vertically pressed at least at respective pressing pressures of 0.5 $gf/cm^2$ and 50 $gf/cm^2$, a difference in depths upon this respective pressing is within a range of 1.5–2.5 mm.

According to the structure above, it is possible to achieve the same effects, like the above-mentioned invention, for a one-ply sanitary tissue paper roll.

A sanitary tissue paper roll according to one aspect of the present invention is such wherein, when a sanitary tissue paper roll of one-ply to three-ply is laid on a horizontal surface with its central axis in a horizontal orientation, a circular plate indenter, having an area of 2 $cm^2$ and being arranged at a center of an upper surface of an outer periphery of a body of the roll, is vertically pressed at least at respective pressing pressures of 0.5 $gf/cm^2$ and 50 $gf/cm^2$, and a difference in depths upon this respective pressing is continuously measured nine times, a difference between a maximum and a minimum of all values of these measurements is within a range of 0.5–1.0 mm.

According to the structure above, since the above-mentioned difference between the maximum and minimum of the measurement values is within a range of 0.5–1.0 mm, an appropriate restorability and ability to deform permanently will be provided. Thus, the sanitary tissue paper roll will be able to possess both an appropriate shape-maintaining ability and tender-touch. To the contrary, if the difference exceeds 1.0 mm, the roll is easily subjected to permanent deformation and a shape-maintaining ability is deteriorated; whereas if the difference is below 0.5 mm, permanent deformation is difficult to occur and the roll will feel hard.

Therefore, according to the above, it is possible to provide a consumer with an appropriate tender-touch feel when the consumer takes the above-mentioned sanitary tissue paper roll in his/her hand, and the roll will appropriately maintain its roll shape and be superior in appearance due to its appropriate shape-maintaining ability.

In a sanitary tissue paper roll according to one aspect of the above-mentioned present invention, it is possible that, when a difference in depths upon respective pressing is continuously measured nine times, all values of these measurements are within a range of a difference in pressing depth; and a difference between a maximum and a minimum of all values of these measurements is within a range of 0.5–1.0 mm.

Further, in a sanitary tissue paper roll according to one aspect of the above-mentioned present invention, it is possible that an elongation rate in a longitudinal direction of sanitary tissue paper of the sanitary tissue paper roll is 20–35%.

According to the structure above, since a sanitary tissue paper having an elongation rate, in the longitudinal direction, of 20–35% is used for the sanitary tissue paper roll, it is possible to easily set a difference in pressing depth in a rolled state within an appropriate range (range of 2.5–3.5 mm for two-ply or three-ply, and range of 1.5–2.5 mm for one-ply), as well as provide a shape-maintaining ability to the roll.

For example, in case a sheet having an elongation rate below 20% is used, when the sheet is wound into a roll with a constant winding tension, since crepes (wrinkles along a width direction of the sheet, a plurality of which are provided in the longitudinal direction) are fully stretched and no elongation remains, there are cases where bulkiness becomes small and the roll becomes hard. On the other hand, if the sheet is wound with a low roll compressibility to maintain elongation in order to avoid the above-mentioned situation, since the crepes are small, a space tends to be created between the sheets and winding becomes loose, resulting in that the roll is easily deformed by, for example, a lateral protrusion of a side-end surface of the roll in a telescopic manner. That is, it is difficult to cope with both setting the above-mentioned difference in pressing depth, which expresses roll hardness, within the above-mentioned appropriate range, and maintaining the shape of the roll.

Further, in case a sheet having an elongation rate exceeding 35% is used, crepes remain too large when the sheet is wound into a roll, resulting in that bulkiness becomes too large and the roll becomes excessively soft. Therefore, it is difficult to set the above-mentioned difference in pressing depth within the above-mentioned appropriate range.

Contrary to the above, if a sheet having an elongation rate of 20–35% is used, since crepes remain to have an appropriate size even when the sheet is wound into a roll, bulkiness can be set to an appropriate extent, and a difference in pressing depth can easily be set within the above-mentioned appropriate range. Further, since sheets, which are stacked in a radial direction, are resiliently bound together because of the crepes remaining in an appropriate size, side-end surfaces will not easily protrude laterally in a telescopic manner, and a roll-shape-maintaining ability is superior. That is, it is possible to achieve both setting the above-mentioned difference in pressing depth within the appropriate range, and maintenance of the shape of the roll.

The invention of a sanitary tissue paper roll according to another aspect of the present invention is made by winding one sheet or two layered sheets of sanitary tissue papers wherein a roll compressibility of the roll is 0.68–0.74 $m/cm^2$, with the roll compressibility being defined as a value obtained by dividing a roll length by a cross section of the roll.

According to the structure above, when the roll compressibility is within a range of 0.68–0.74 $m/cm^2$, the roll will be rich in terms of a thickness feeling and bulk softness while being difficult to deform, and embosses will not easily be flattened in case embossing is applied. To the contrary, if the roll compressibility exceeds 0.74 $m/cm^2$, winding will be too hard and a thickness feeling and bulk softness will decrease. Then, if the roll compressibility is below 0.68 $m/cm^2$, deformation will easily occur and massiveness when held will decrease.

Further, a sanitary tissue paper roll according to one aspect of the above-mentioned present invention is such that a dry-state tensile strength, which is measured according to a tensile-characteristic testing method defined by JISP8113, per each sheet of sanitary tissue paper is equal to at least 40 N/m in a width direction, and is 1.0–4.0 folds of the width direction in a longitudinal direction.

According to the structure above, by heightening a width-direction dry-state tensile strength to a necessary-and-sufficient extent and also setting a longitudinal-direction dry-state tensile strength to 1.0–4.0 folds of the width-direction dry-state tensile strength, the sanitary tissue paper will not easily be tightened into a hard, thin state upon winding or after winding, and thus, a thickness feeling, bulk softness and massiveness upon usage are sufficiently secured, even if the roll compressibility is set to be 0.68–0.74 $m/cm^2$. Particularly, in case embossing is applied to the sanitary tissue paper, this emboss is not easily flattened and will clearly remain upon usage, and a thickness feeling, bulk softness and massiveness will not easily be lost.

Further, a sanitary tissue paper roll according to one aspect of the above-mentioned present invention is such that a number of crepes of sanitary tissue paper is 25–45 per cm, and an elongation rate in a longitudinal direction is 15–25%.

According to the structure above, by forming the crepes (wrinkles along the width direction of the sheet, a plurality of which are provided in the longitudinal direction) and setting the elongation rate, in the longitudinal direction, to be 12–25%, the thickness feeling, bulk softness and massiveness upon usage are further enhanced, and particularly, in case embossing is applied, this emboss is further difficult to be flattened.

Further, a sanitary tissue paper roll according to one aspect of the above-mentioned present invention is such that per each sheet of sanitary tissue paper, grammage is 15–25 $g/m^2$, density is 0.10–0.15 $g/cm^3$, and thickness is 120–170 μm.

When particularly using such a sanitary tissue paper, the above and below mentioned effects will sufficiently be achieved.

Further, a sanitary tissue paper roll according to one aspect of the above-mentioned present invention uses, as sanitary tissue paper, a paper made mainly of Nadelholz bleached kraft pulp and Laubholz bleached kraft pulp and having a weight proportion of Nadelholz bleached kraft pulp to Laubholz bleached kraft pulp of 10:90–70:30.

The present invention can be preferably used for sanitary tissue paper rolls of such pulp products.

Further, a sanitary tissue paper roll according to one aspect of the above-mentioned present invention is made by winding one sheet or two layered sheets of sanitary tissue paper having been embossed.

The present invention is preferable for sanitary tissue paper rolls with embosses, and as described above, this applied emboss is difficult to flatten and will clearly remain upon usage, and thus, an effect is achieved in that a thickness feeling, bulk softness and/or massiveness are not easily lost.

Further, a sanitary tissue paper roll according to one aspect of the above-mentioned present invention has a roll length of 58–65 m in a case of winding one sheet of sanitary tissue paper, and a roll length is 29–33 m in a case of winding two layered sheets of sanitary tissue papers.

A preferable object of the present invention is a toilet paper roll, and in consideration of attaching the roll to a typical roll holder, it is necessary for an outer diameter to be about 100–118 mm. According to a range of roll compressibility of the present invention, by setting a roll length within the above-mentioned range, it is possible to set the outer diameter within a range attachable to a typical roll holder. Further, in this case, the above-mentioned effects are also sufficiently achieved.

Further, a sanitary tissue paper roll according to one aspect of the above-mentioned present invention is made by winding sanitary tissue paper around a core having an outer diameter of 30–40 mm.

As for a sanitary tissue paper roll, in addition to a cored type roll in which paper is wound around a paper core, there exists a non-cored type in which there is no core, and the present invention is applicable to both types. According to the structure above, particularly for the case of a cored-type roll, by setting the outer diameter of the core to be 30–40 mm when taking the roll compressibility range of the present invention, it is possible to set an outer diameter within a range attachable to a typical roll holder. Further, in this case, the above-mentioned effects are also sufficiently achieved.

The invention of a method of manufacturing a sanitary tissue paper roll according to another aspect of the present invention comprises: making a sanitary tissue paper by setting a jet flow speed of pulp slurry/wire speed ratio (J/W ratio) to be 0.92–1.00, winding one sheet or two-layered sheets of this paper, and obtaining a roll in which a roll compressibility thereof is 0.68–0.74 $m/cm^2$, with the roll compressibility being defined as a value obtained by dividing a roll length by a cross section of the roll.

According to the structure above, by setting the jet flow speed of pulp slurry/wire speed ratio (J/W ratio) to be 0.92–1.00 upon making a sanitary tissue paper, an amount of fiber oriented in a longitudinal direction will be equal to at least an amount of fiber oriented in a width direction, and thus, it will be possible to set a longitudinal-direction dry-state tensile strength of a manufactured roll to be 1.0–4.0 folds of a width-direction dry-state tensile strength. Therefore, the sanitary tissue paper will not easily be tightened into a hard, thin state upon winding or after winding, and thus, a thickness feeling, bulk softness and massiveness upon usage are sufficiently secured. Particularly, in case embossing is applied to the sanitary tissue paper, this emboss is not easily flattened and will clearly remain upon usage, and the thickness feeling, bulk softness and massiveness will not easily be lost.

The invention of a sanitary tissue paper for a sanitary tissue paper roll according to another aspect of the present invention is such wherein a sample paper is compressed between steel plates, which respectively have a circular surface with a compression area of 2 $cm^2$, at a maximum compression load of 50 $gf/cm^2$, and upon returning of this paper sample, a linearity of a displacement curve between a load and a thickness is 0.2500–0.3300 for a one-ply, and 0.3400–0.3700 for a two-ply, and a thickness upon a load of 50 $gf/cm^2$ is equal to at least 0.1400 mm for a one-ply, and equal to at least 0.2500 mm for a two-ply.

According to the structure above, an appropriate flexible response will be felt upon pushing with a hand.

In the invention of a sanitary tissue paper for a sanitary tissue paper roll according to one aspect of the above-mentioned present invention, it is possible that, a difference between thickness at a load of 0.5 $gf/cm^2$ and a thickness at a load of 50 $gf/cm^2$ is equal to at least 0.2000 mm for a one-ply, and equal to at least 0.2000 mm for a two-ply; and an amount of work upon compression is equal to at most 0.2000 $gf*cm/cm^2$ for a one-ply, and equal to at most 0.2200 $gf*cm/cm^2$ for a two-ply.

According to the structure above, paper quality will have bulk softness.

The invention of a sanitary tissue paper for a sanitary tissue paper roll according to another aspect of the present invention is such wherein, in a relationship between curvature and flexural moment upon: chucking a paper sample having a width of 20 cm at a chuck distance of 1 cm; bending the paper forward up to a maximum curvature of 2.5 $cm^{-1}$ through pure bending by always keeping one side to form an arc; bending the paper back to its original position; bending the paper backwardly at a maximum curvature of −2.5 $cm^{-1}$; and returning the paper to its original position, an average value of a paper's bending resistance in longitudinal and lateral directions is equal to at most 0.0080 $gf*cm^2/cm$ for a one-ply, and equal to at most 0.0180 $gf*cm^2/cm$ for a two-ply, with the paper's bending resistance being expressed as an average inclination between a curvature of 0.5–1.5 $cm^{-1}$; and an average value of a paper's flexural recoverability in longitudinal and lateral directions is 0.0030–0.0050 gf*cm/cm for a one-ply, and 0.0130–0.0170 gf*cm/cm for a two-ply, with the paper's flexural recoverability being expressed as an average hysteresis width of flexural moment between a curvature of 0.5–1.5 $cm^{-1}$.

According to the structure above, resistance upon bending will be small, and the paper will have an appropriate bending recoverability.

The invention of a sanitary tissue paper for a sanitary tissue paper roll according to another aspect of the present invention is such wherein an average value between an average deviation of a friction coefficient obtained for longitudinal and lateral directions on a front side and that obtained for longitudinal and lateral directions on a back side for a one-ply is equal to at most 0.032, and, an average value for longitudinal and lateral directions on a front side for a two-ply is equal to at most 0.029, with an average deviation of the friction coefficient being obtained upon: making a friction piece contact a paper sample at a contact pressure of 10 gf, the friction piece being made from a piano wire of which a lateral section is 0.5 mm in diameter, and having a friction surface that is 5 mm long; and moving the friction piece 2 cm at a speed of 0.1 cm/second in a direction orthogonal to a length direction of the friction piece, while the paper sample has applied thereto a tension of 20 gf/cm in the moving direction; and also, an average value between a paper's average friction coefficient obtained for longitudinal and lateral directions on a front side and that obtained for longitudinal and lateral directions on a back side for a one-ply is 0.2600–0.2800, and an average value of a paper's average friction coefficient for longitudinal and lateral directions on a front side for a two-ply is 0.3500–0.3800.

According to the structure above, smoothness is provided since variation is small, and also, an appropriate frictional resistance is provided, and a stableness in terms of smooth feeling is provided.

Further, in a sanitary tissue paper for a sanitary tissue paper roll according to one aspect of the present invention, it is possible that, grammage is 15–25 g/m$^2$; paper thickness is 120–180 μm; longitudinal/lateral ratio of tension is 2.0–3.0; elongation rate, in a longitudinal direction, is 20–35%; longitudinal tensile strength is 110–115 N/m; and number of crepes is 30–50 per cm.

Examples (A) First, a preferred embodiment will be explained in detail, with reference to the accompanying drawings, in view of the first object, which is to provide a sanitary tissue paper roll which can provide an appropriate tender-touch feeling when a consumer takes the roll in his/her hand.

A toilet paper roll, which is the sanitary tissue paper roll in the present embodiment, is quantitatively measured according to the method explained below so that roll hardness will be within an appropriate range as described below. Thus, it is possible to supply, to the market, toilet paper rolls which provide an appropriate tender-touch feeling to the consumer.

FIG. 1 is a perspective view showing a measurement method for roll hardness of a toilet paper roll according to the present embodiment. The roll hardness of a toilet paper roll 1 is quantitatively measured according to the following steps:

(1) First, the toilet paper roll 1 is laid on a horizontal platform 5 so that a central axis 1*a* is in a horizontal direction.

(2) Then, a circular plate indenter 3, having an area of 2 cm$^2$ and assumed as an index finger of a person, is abutted against a center of an upper surface of an outer periphery of a roll body.

(3) A pressing depth of the above-mentioned circular plate indenter 3 in this abutted state is taken as zero, and this circular plate indenter 3 is pressed vertically at a pressing pressure of 0.5 gf/cm$^2$ and a pressing speed of 10 mm/minute.

(4) When a pressing depth of the above-mentioned indenter 3 becomes stable, the pressing depth is recorded as a first pressing depth.

(5) Then, continuously, the above-mentioned indenter 3 is vertically pressed at the same pressing speed and with a pressing pressure increased to 50 gf/cm$^2$.

(6) When a pressing depth of the above-mentioned indenter 3 becomes stable, the pressing depth is recorded as a second pressing depth.

(7) A difference between the second pressing depth and the first pressing depth (described as "difference in pressing depth") is recorded as roll hardness, and then the pressing pressure on the above-mentioned indenter is released.

Note that, a first pressing (the pressing of above-mentioned (3)) among this two-step pressing operation is assumed as a pushing action by the finger when the consumer takes a toilet paper roll in his/her hand. On the other hand, a second pressing (the pressing of above-mentioned (5)) is assumed as a pushing action by the consumer when he pushes his/her finger into the roll in order to check hardness of the roll that he is holding. That is, this consumer's action of checking the hardness of a toilet paper roll can be approximated by the above-mentioned two-step pressing operation, and, a feeling of the roll hardness the consumer receives thereupon can be alternatively expressed through the difference in pressing depth.

Figure 2:
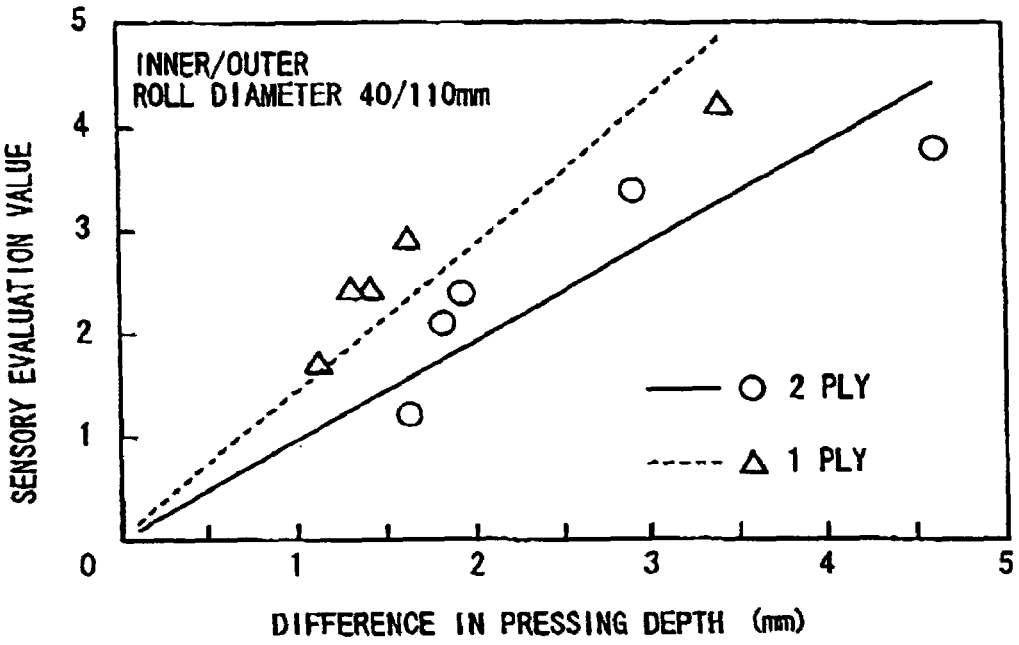
FIG. 2 is a diagram of a correlation between a difference in pressing depth and a sensory-evaluation value for a toilet paper roll having an inner/outer roll diameter of 40 mm/110 mm.

The difference in pressing depth thus measured shows a high correlation with a sensory-evaluation value of roll hardness actually felt by a person. FIG. 2 shows a correlation diagram respectively for one-ply and two-ply toilet paper rolls having a roll width of 114 mm, and an inner/outer roll diameter of 40 mm/110 mm. Note that this correlation diagram between difference in pressing depth and sensory-evaluation value has been obtained by having 50 people rate sensory-evaluation values of toilet paper rolls, which respectively have different values of difference in pressing depth, on a 1-to-5 scale (1: too hard, 2: slightly hard, 3: suitably soft, 4: rather too soft, 5: too soft). Plotted points on the correlation diagram representatively show only an average value of the sensory-evaluation values for each of the toilet paper rolls in order to avoid complicity of the diagram.

From the diagram, it can be appreciated that the above-mentioned difference in pressing depth has a good correlation with the sensory-evaluation value of roll hardness felt by a person. Note that a correlation coefficient between the above-mentioned difference in pressing depth and the above-mentioned sensory-evaluation value (1–5) is 0.79 for one-ply and 0.83 for two-ply, and, it can be concluded that the above-mentioned difference in pressing depth can sufficiently be used as an evaluation index for alternatively expressing the roll hardness felt by a person.

Note that, although this correlation diagram concerns results for a toilet paper roll having an inner/outer roll diameter of 40 mm/110 mm, a similar correlation was obtained when such correlation was checked for rolls having outer roll diameters of 100 mm and 120 mm respectively having varied inner roll diameters of 30 mm and 50 mm. Thus, it became clear that a person feels the same hardness for a standard toilet paper roll with an outer roll diameter ranging in 100–120 mm and an inner roll diameter ranging in 30–50 mm even if the inner/outer roll diameter is different, as long as the difference in pressing depth is the same. Therefore, as for the above-mentioned standard toilet paper roll, it is possible to uniquely and quantitatively evaluate the roll hardness felt by a person according to the difference in pressing depth regardless of inner/outer roll diameter.

From such correlation diagrams, the difference in pressing depth corresponding to a range in which a person has a suitably soft feel, that is, the range in which the above-mentioned sensory-evaluation value is between 2.5–3.5, is between 2.5–3.5 mm for a two-ply toilet paper roll, and is between 1.5–2.5 mm for a one-ply roll. These are appropriate ranges for the difference in pressing depth. Therefore, by keeping the difference in pressing depth of a toilet paper roll within the above-mentioned appropriate ranges, it becomes possible to provide an appropriate tender-touch to a consumer who has taken the toilet paper roll. Thus, it is possible to supply, to the market, toilet paper rolls which provide an appropriate tender-touch feeling to the consumer.

Figure 3:
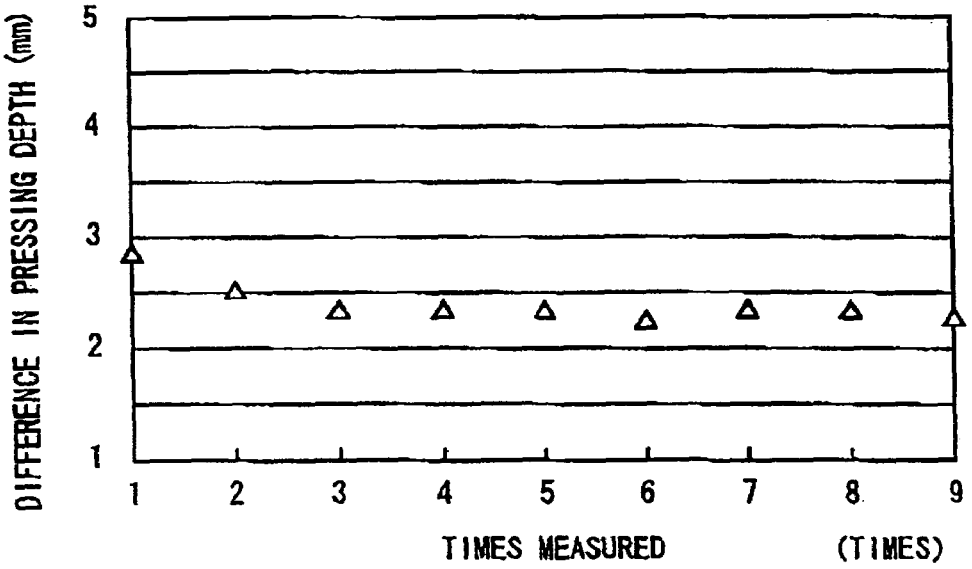
FIG. 3 is a graph showing measurement results upon continuously measuring the above-mentioned difference in pressing depth nine times for the above-mentioned two-ply toilet paper roll having an inner/outer roll diameter of 40 mm/110 mm.

Note that, with regard to desirably for the toilet paper roll according to the present embodiment, as shown in FIG. 3, it is preferable that nine measurement values of the difference in pressing depth, obtained by continuously conducting the above-mentioned measurement nine times, are all within the above-mentioned appropriate ranges and that a difference between a maximum and minimum of the above-mentioned measurement values is within a range of 0.5–1.0 mm. This is because if the above-mentioned difference between the maximum and minimum of the above-mentioned measurement values exceeds 1.0 mm, the roll is easily subjected to permanent deformation and a shape-maintaining ability is deteriorated; whereas if the difference is below 0.5 mm, permanent deformation is difficult to occur and the roll feels hard. To the contrary, if the above-mentioned difference is within the 0.5–1.0 mm range, restorability and an ability to deform permanently will be appropriate; that is, the roll will have both an appropriate shape-maintaining ability and soft feel and be superior not only in its sense of touch but also in its appearance, and thus, it will be possible to appeal to a consumer's sense of beauty. The number of times of measurement is set at nine times because a minimum value of the difference in pressing depth will sufficiently settle to a constant value through nine times of measurement.

Figure 4A:
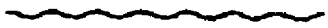
FIG. 4(*a*) is a side sectional view of a sheet with a small elongation rate, and FIG. 4(*b*) is a side sectional view of a sheet with a large elongation rate.
Figure 4B:
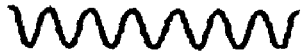

Further, it is desirable that a sheet (sanitary tissue paper) having an elongation rate, in a longitudinal direction, of 20–35% is used for the above-mentioned toilet paper roll. Accordingly, it is possible to facilitate manufacturing of the toilet paper roll. Here, "elongation rate" is an amount of elongation per unit length in a longitudinal direction when tension is imparted in longitudinal direction until the sheet shears. This amount of elongation is mainly due to the crepes (wrinkles along a width direction of the sheet, a plurality of which are provided in the longitudinal direction) as appreciated from a side section of the sheet shown in FIG. 4. The elongation rate becomes small as a dimension of the crepes or waves becomes large or the number of crepes per unit length decreases, as shown in FIG. 4(*a*); whereas, the elongation rate becomes large as the above-mentioned waves become small or the above-mentioned number of crepes increases, as shown in FIG. 4(*b*).

Figure 5A:
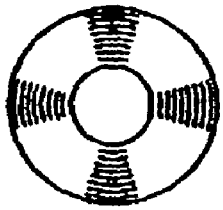
FIGS. 5(*a*)–5(*b*) are side views of a toilet paper roll.
Figure 5B:
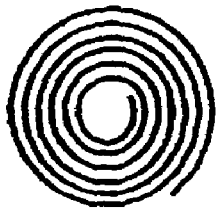
Figure 5C:
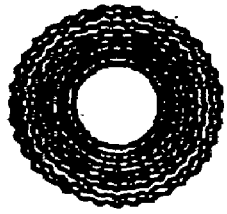

In case a sheet having a small elongation rate below 20% is used, when the sheet is wound into a roll with a constant winding tension, since the crepes are fully stretched and no elongation remains as seen in FIG. 5(*a*), bulkiness becomes small and the roll becomes hard. On the other hand, if the sheet is wound with a low roll compressibility to maintain elongation in order to avoid the above-mentioned situation, since the crepes are small as seen in FIG. 5(*b*), a space tends to be created between the sheets and winding becomes loose, resulting in that the roll is easily deformed by, for example, lateral protrusion of a side-end surface of the roll in a telescopic manner. That is, in the case of a sheet having an elongation rate below 20%, it is difficult to achieve both setting the above-mentioned difference in pressing depth, which expresses the roll hardness, within the above-mentioned appropriate range, and maintaining a shape of the roll.

Further, in case a sheet having a large elongation rate exceeding 35% is used, the crepes remain too large when the sheet is wound into a roll, resulting in that bulkiness becomes too large and the roll becomes excessively soft. Therefore, it is difficult to set the above-mentioned difference in pressing depth within the above-mentioned appropriate range.

Contrary to the above, if a sheet having an appropriate elongation rate of 20–35% is used, since the crepes remain to have an appropriate size as those shown in FIG. 5(*c*) even when the sheet is wound into a roll, bulkiness can be set to an appropriate extent, and a difference in pressing depth can easily be set within the above-mentioned appropriate range. Further, since the sheets, which are stacked in a radial direction, are resiliently bound together because of the crepes remaining in an appropriate size, side-end surfaces will not easily protrude laterally in a telescopic manner, and a roll-shape-maintaining ability is superior. That is, it is possible to achieve both setting the above-mentioned difference in pressing depth within the appropriate range, and maintenance of a shape of the roll. Therefore, it is possible to facilitate manufacturing of toilet paper rolls.

Note that the above-mentioned elongation rate can be varied according to, for example, material, strength and humidity. For example, regarding material, the elongation rate will increase if the below-described NBKP mixing rate is high, and also, the elongation rate will increase if beating is performed and tensile strength is increased.

Below, explanation will be made of a manufacturing specification of a toilet paper roll preferable for setting a difference in pressing depth within the above-mentioned appropriate range.

(1) A sheet has a grammage of 15–25 g/m$^2$, and its paper thickness is 120–160 μm per sheet.

(2) A longitudinal/lateral ratio of dry-state tensile strength of the sheet is 2.0–4.0. Here, "dry-state tensile strength" is tensile strength measured according to tensile-characteristic testing method defined by Japan Industrial Standard, JISP8113. The "longitudinal/lateral ratio of dry-state tensile strength" indicates a ratio obtained by dividing the dry-state tensile strength in a longitudinal direction by the dry-state tensile strength in a width direction. Here, a tensile-characteristic testing method defined by JISP8113 will be explained. Firstly, a 25 mm-wide sheet, taken as a test piece, is placed in an atmosphere defined by JISP8111 (an atmosphere with a temperature of 23±1° C. and humidity of 50±2%), and is left in this state until the temperature and humidity of the above-mentioned test piece reaches an equilibrium. When an equilibrium is reached, both sides, in a longitudinal direction, of the test piece are pinched with an interval of 180±1 mm, and the test piece is pulled at a constant speed of 20±5 mm/minute until the piece shears. A maximum load thereupon is converted to a value per width to thus obtain the above-mentioned tensile strength.

A sheet having such a longitudinal/lateral ratio can be manufactured by adjusting a jet flow speed of pulp slurry/wire speed ratio (J/W ratio), and appropriately adjusting an amount of fiber oriented in the longitudinal direction to be more than an amount of fiber oriented in the width direction.

Here, "jet flow speed of pulp slurry" is a flow speed right after jetting of a pulp feedstock onto an endless wire along its traveling direction during a papermaking process (which is a process of making a thin, continuous sheet of uniform thickness by flowing a pulp feedstock, made by including pulp in water, onto a traveling endless wire and making paper). Further, "wire speed" is a traveling speed of the above-mentioned endless wire.

(3) An NBKP mixing rate in pulp feedstock is 20–60%. Here, "NBKP mixing rate" indicates a weight proportion of Nadelholz bleached kraft pulp (NBKP) in the above-mentioned pulp feedstock, which is composed of Nadelholz bleached kraft pulp (NBKP) and Laubholz bleached kraft pulp (LBKP). With the above mentioned NBKP mixing rate, it is possible to make a sheet enhanced both in terms of strength due to use of Nadelholz bleached kraft pulp, and soft tender-touch due to use of Laubholz bleached kraft pulp. Note that the feedstock is not limited only to pulp, and used-paper feedstock can be used.

(4) The sheet has been subjected to an embossing process. Through this embossing process, since rigidity of the sheet can be enhanced, it is possible to make the roll have an appropriate roll hardness even under conditions where roll compressibility is low. Thus, a range of roll compressibility for achieving the above-mentioned difference in pressing depth can be broadened.

(5) The roll compressibility of the roll is 0.68–0.74 m/cm$^2$. Here, "roll compressibility" is a value obtained by dividing roll length of the roll by an area of a side-end surface of the roll (i.e., an area of a surface orthogonal to a central axis of the roll). Adjustment of the roll compressibility can be accomplished by adjusting a winding tension applied to the sheet upon winding the sheet into a roll.

(6) The roll length of the roll is 58–65 m for one-ply, 29–33 m for two-ply, and 19–22 m for three-ply.

Note that an inner/outer roll diameter is within a range where the inner diameter is 30–50 mm, and the outer diameter is 100–120 mm, as explained above.

Tables 1 and 2 show manufacturing specifications and roll hardness of one example of a toilet paper roll manufactured according to the above-mentioned manufacturing specification, compared to commercial toilet paper rolls now on the market. Note that Table 1 is of a two-ply toilet paper roll, and Table 2 is of a one-ply roll. Both commercial two-ply and one-ply rolls have a difference in pressing depth which is not within the above-mentioned appropriate range. Further, an average value of a sensory-evaluation value obtained from the above-mentioned 50 persons, shown at the bottommost rows in Tables 1 and 2, is not within the range of 2.5–3.5 which provides a suitably soft feel. To the contrary, results for both the one-ply and two-ply rolls according to the present example are satisfactory: a difference in pressing depth is within the above-mentioned appropriate range, and sensory-evaluation values are 3.4 and 2.9, respectively. Further, as for a difference between a maximum and minimum of measurement values obtained by continuously measuring the above-mentioned difference in pressing depth nine times, the values for the commercial rolls are not in the range of 0.5–1.0 mm. To the contrary, since the present example is within the above-mentioned range and is provided with an appropriate shape-maintaining ability in addition to the above-mentioned suitable soft feel, the rolls will not easily be deformed in shape when displayed in stores and will have a superior appearance.

TABLE 1

| two-ply | | Example | Commercial product 1 | Commercial product 2 | Commercial product 3 | Commercial product 4 |
|---|---|---|---|---|---|---|
| MANUFACTURING SPECIFICATION | Grammage (g/m$^2$) | 16.5 | 16.5 | 16.3 | 16.4 | 15.3 |
| | Paper thickness (μm) | 141 | 138 | 118 | 137 | 110 |
| | Elongation rate (%) | 24.5 | 16.3 | 15.1 | 16.3 | 12.2 |
| | NBKP mixing rate (%) | 30 | 30 | — | — | — |
| | Inner roll diameter (mm) | 38 | 45 | — | — | — |
| | Outer roll diameter (mm) | 109 | 110 | — | — | — |
| | Roll length (m) | 30 | — | — | — | 40 |
| | Roll compressibility (m/cm$^2$) | 0.73 | 0.76 | — | — | 1.01 |
| | Presence of emboss | present | — | — | — | — |
| | Longitudinal-direction dry-state tensile strength (CN) | 298 | 372 | 299 | 295 | 237 |
| | Lateral-direction dry-state tensile strength (CN) | 125 | 147 | 93 | 106 | 59 |
| | Tensile strength longitudinal/lateral ratio | 2.38 | 2.53 | 3.22 | 2.78 | 4.02 |
| ROLL HARDNESS | Difference in pressing depth (mm) | 2.9 | 1.8 | 4.6 | 1.9 | 1.6 |
| | Difference between maximum and minimum of difference in pressing depth measured nine times (mm) | 0.7 | 0.4 | 1.3 | 0.4 | 0.4 |
| | Sensory-evaluation value (average) | 3.4 | 2.1 | 3.8 | 2.4 | 1.2 |

TABLE 2

| one-ply | | Example | Commercial product 1 | Commercial product 2 | Commercial product 3 | Commercial product 4 |
|---|---|---|---|---|---|---|
| MANUFACTURING SPECIFICATION | Grammage (g/m$^2$) | 20.2 | — | 20.5 | 19.3 | 20 |
| | Paper thickness (μm) | 136 | 130 | 127 | 140 | 162 |
| | Elongation rate (%) | 26.2 | 18.1 | 10.5 | 17.9 | 19 |
| | NBKP mixing rate (%) | 30 | 30 | — | — | — |
| | Inner roll diameter (mm) | 38 | 45 | — | — | — |
| | Outer roll diameter (mm) | 109 | 110 | — | — | — |

TABLE 2-continued

| | one-ply | Example | Commercial product 1 | Commercial product 2 | Commercial product 3 | Commercial product 4 |
|---|---|---|---|---|---|---|
| | Roll length (m) | 60 | — | — | — | — |
| | Roll compressibility (m/cm$^2$) | 0.73 | 0.76 | — | — | — |
| | Presence of emboss | present | — | — | — | — |
| | Longitudinal-direction dry-state tensile strength (CN) | 311 | 359 | 233 | 285 | 300 |
| | Lateral-direction dry-state tensile strength (CN) | 110 | 103 | 102 | 104 | 100 |
| | Tensile strength longitudinal/lateral ratio | 2.83 | 3.49 | 2.28 | 2.74 | 3 |
| ROLL HARDNESS | Difference in pressing depth (mm) | 1.6 | 1.4 | 3.4 | 1.3 | 1.1 |
| | Difference between maximum and minimum of difference in pressing depth measured nine times (mm) | 0.5 | 0.4 | 1.2 | 0.4 | 0.3 |
| | Sensory-evaluation value (average) | 2.9 | 24 | 42 | 2.4 | 1.7 |

(B) Next, a preferred embodiment will be explained in detail, with reference to the accompanying drawings, in view of the second object, which is to provide a sanitary tissue paper roll which is rich in thickness feeling and bulk softness while being difficult to deform, which has a sufficient massiveness when taken in the hand, and in which an emboss is not easily flattened in case embossing is applied.

Note that, although the embodiments of the present invention are described in detail regarding examples of toilet paper rolls having cores, it is of course possible to apply the present invention to other sanitary tissue paper rolls such as toilet paper rolls without cores, and kitchen paper rolls.

Figure 6:
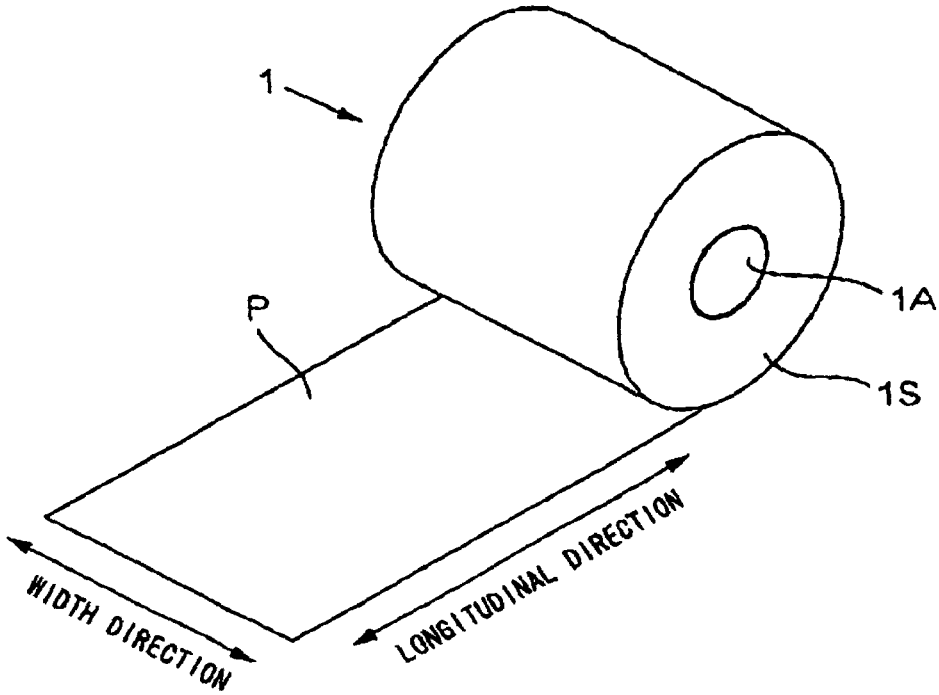
FIG. 6 is a schematic perspective view of an example of a cored-toilet paper roll.

FIG. 6 shows an example of a cored toilet paper roll 1 made by winding a one sheet or two-layered sheets of sanitary tissue papers P around a core 1A such as a paper core. Meanings of terms of the present invention will be defined: "roll length" is a length of sanitary tissue paper P in a winding direction (longitudinal direction), "roll cross section" is an area of a surface orthogonal to a central axis of the roll (which is equal to an area of a side plane 1S), and "width direction" is a direction parallel to a direction of the central axis (or a direction orthogonal to the longitudinal direction).

In the present invention, a roll is formed so that roll compressibility, which is a value determined by dividing the roll length of the roll by the roll cross section, is 0.68–0.74 m/cm$^2$. A particularly appropriate range of roll compressibility is 0.70–0.74 m/cm$^2$. Adjustment of the roll compressibility can be accomplished by adjusting tension applied to the sanitary tissue paper P upon winding. As described above, if the roll compressibility exceeds 0.74 m/cm$^2$, winding will be too hard causing loss of embosses and loss of thickness feeling and/or bulk softness; whereas if the roll compressibility is below 0.67 M/cm$^2$, windings will loosen, the roll will tend to deform in a telescopic manner, its sectional shape will easily deform in to a polygonal shape, and massiveness when taken in the hand will be lost.

As for strength of the sanitary tissue paper P per sheet, it is desirable to heighten a width-direction dry-state tensile strength, which is measured according to the tensile-characteristic testing method defined by JISP8113, to a necessary-and-sufficient extent equal to at least 40 N/m, and desirably 40–45 N/m; and also, it is desirable to set a longitudinal-direction dry-state tensile strength to 1.0–4.0 folds, and desirably 2.5–3.5 folds of the width-direction dry-state tensile strength. Through such a structure, the sanitary tissue paper P will not easily be tightened into a hard, thin state upon winding or after winding, and thus, a thickness feeling, bulk softness and massiveness upon usage are sufficiently secured, even if the roll compressibility is set to be 0.68–0.74 M/cm$^2$. Particularly, in case embossing (not shown) is applied to the sanitary tissue paper P, this emboss is not easily flattened and will clearly remain upon usage, and the thickness feeling, bulk softness and massiveness will not easily be lost.

In order to manufacture such sanitary tissue paper P, it is recommended for a jet flow speed of pulp slurry/wire speed ratio (J/W ratio) to be 0.92–1.00 upon papermaking. Through such a structure, an amount of fiber oriented in the longitudinal direction will be equal to at least an amount of fiber oriented in the width direction, and thus, it will be possible to set the longitudinal-direction dry-state tensile strength of a manufactured roll to be 1.0–4.0 folds of the width-direction dry-state tensile strength.

Regarding the core 1A used for the cored-type roll, as is well known, a paper core made of cardboard with a thickness of about 0.5 mm is preferable. However, it is also possible to use a core made, for example, of resin. It is preferred for the paper core 1A to have an inner diameter of about 30–40 mm. A diameter of a shaft of a shaft-mounting type roll holder, or a width of a holding piece of a one-touch type roll holder, is about 20–25 mm, and thus, a paper core with an inner diameter at most equal to than 30 mm will not fit well, or will not rotate with ease. Further, if an inner diameter of the paper core becomes small, twisting may occur in the paper core upon roll winding, which may be a cause of defectively wound items.

Further, it is desirable for the sanitary tissue paper P constituting the roll of the present invention to have a grammage of 15–25 g/m$^2$, density of 0.10–0.15 g/cm$^3$, and a thickness of 120–170 μm, and particularly 160–170 μm, per sheet.

Particularly, in this type of sanitary tissue paper roll, there are cases where crepes (wrinkles along the width direction of the sheet, a plurality of which are provided in the longitudinal direction) are applied. The present invention may adopt such a structure, and it is preferable that the number of crepes is 25–45 per cm, particularly 42–45 per cm, and an elongation rate in the longitudinal direction is 15–25%, preferably 22–25%.

Further, as for the sanitary tissue paper P constituting the roll of the present invention, it is desirable to use a paper made mainly of Nadelholz bleached kraft pulp (NBKP) and Laubholz bleached kraft pulp (LBKP), and having a weight proportion of Nadelholz bleached kraft pulp to Laubholz bleached kraft pulp of 10:90–70:30. Particularly, by setting this NBKP: LBKP rate to be within a range of 1:2–1:3, it is possible to achieve both an enhancement in strength, which is caused by using Nadelholz bleached kraft pulp, and an enhancement in soft tender-touch, which is caused by using Laubholz bleached kraft pulp.

Furthermore, in the present invention, it is possible to enhance a thickness feeling and bulk softness by using a sanitary tissue paper P having been embossed. As described above, although sanitary tissue paper rolls with embosses have been known, this embossing is stretched and flattened, and a thickness feeling and bulk softness are lost upon winding or as time passes due to tension in a winding direction. To the contrary, since the roll of the present invention has a roll compressibility of 0.68–0.74 m/cm$^2$, an applied emboss is not easily flattened and will clearly remain upon usage, and a thickness feeling, bulk softness and massiveness will not be lost easily. Note that it is possible to adopt known embossing methods and emboss shapes and/or arrangements. Specifically, it is possible to adopt, before winding, a method of forming embosses in which a sanitary tissue paper is passed between a steel roll having emboss patterns and a rubber roll and pressurized, or, a method of forming embosses in which a sanitary tissue paper is passed between a steel roll having male emboss patterns and a steel roll having female emboss patterns and pressurized.

Further, in case of application to toilet paper rolls as in the present example, it is desirable that an outer roll diameter is about 100–118 mm. Particularly, it is desirable that the outer diameter is 110–115 mm, in order to facilitate holding a roll in a roll holder and facilitate rotation of the roll upon usage.

For this reason, in the present invention, roll length for a one-ply product may be 58–65 m, and roll length for a two-ply product may be 29–33 m, and, an outer diameter of the core 1A may be 30–40 mm, and particularly, preferably 36–39 mm.

Below, effects of the present invention will be explained through examples.

As shown in Table 3 and Table 4, various types of toilet paper rolls are manufactured or obtained. A measurement for tensile strength is performed, and also, tender-touch, bulk softness, thickness feeling, appearance of embosses (remaining state of the embosses), and roll shape and massiveness were respectively evaluated on a 1-to-5 scale by 50 people, and an average value was taken as an evaluation value. Measurement results and evaluation results are also shown in Table 3 and Table 4.

TABLE 3

| | | Example 1 | Example 2 | Comparative Example 1 | Comparative Example 2 | Commercial Product 1 | Commercial Product 2 | Commercial Product 3 | Commercial Product 4 | Commercial Product 5 |
|---|---|---|---|---|---|---|---|---|---|---|
| MANUFACTURING CONDITION | TYPE | one-ply | two-ply | one-ply | two-ply | one-ply | one-ply | one-ply | one-ply | one-ply |
| | Grammage (g/m$^2$) | 20.5 | 16.8 | 20.5 | 16.6 | 20.5 | 19.2 | 19 | 27.2 | 35.5 |
| | Paper thickness (μm) | 142 | 128 | 139 | 133 | 120 | 134 | 144 | 187 | 247 |
| | Density (g/cm$^3$) | 0.144 | 0.131 | 0.147 | 0.125 | 0.171 | 0.143 | 0.132 | 0.145 | 0.144 |
| | Paper core inner diameter (mm) | 38 | 38 | 45 | 45 | 45 | 45 | 45 | 35 | 35 |
| | Roll length (m) | 60.4 | 60.5 | 60.4 | 60.4 | 60.9 | 60.9 | 60.4 | 57.87 | 45.59 |
| | Outer diameter (mm) | 109 | 111 | 110 | 109.2 | 111.3 | 110.7 | 109.4 | 126.1 | 126.3 |
| | Roll compressibility (m/cm2) | 0.743 | 0.714 | 0.771 | 0.784 | 0.755 | 0.765 | 0.781 | 0.505 | 0.396 |
| | NBKP:LBKP | 32:68 | 26:74 | 25:75 | 33:67 | — | — | — | — | — |
| | J/W ratio upon papermaking | 0.96 | 0.99 | 0.91 | 0.9 | — | — | — | — | — |
| TENSILE TEST | Longitudinal-direction dry-state tensile strength (N/m) | 113 | 149 | 128 | 163 | 116 | 127 | 122 | 95.2 | 85.6 |
| | Width-direction dry-state tensile strength (N/m) | 43 | 47 | 38 | 42 | 36 | 44 | 38 | 56.8 | 58.4 |
| | Tensile strength ratio | 2.6 | 3.2 | 3.4 | 3.9 | 3.22 | 2.89 | 3.21 | 1.68 | 1.47 |
| SENSORY EVALUATION | Tender-touch | 4 | 4.1 | 2.8 | 3.3 | 3.1 | 3 | 3 | 3.5 | 4.1 |
| | Bulk Softness | 3.9 | 4.3 | 2.7 | 2.7 | 2.5 | 3.1 | 3 | 3.9 | 3.4 |
| | Thickness feeling | 3.8 | 3.8 | 2.6 | 2.8 | 2.3 | 3.4 | 3.3 | 4.1 | 4.5 |
| | Emboss appearance | 4.1 | 4.2 | 3.2 | 3.3 | 2.4 | 3.4 | 3.2 | 3.4 | 3.2 |
| | Roll shape, Massiveness | 4 | 4.3 | 3.5 | 3.6 | 3.4 | 3.5 | 3.5 | 2.8 | 2 |

TABLE 4

| | | Commercial Product 6 | Commercial Product 7 | Commercial Product 8 | Commercial Product 9 | Commercial Product 10 | Commercial Product 11 | Commercial Product 12 |
|---|---|---|---|---|---|---|---|---|
| MANUFACTURING CONDITION | TYPE | one-ply | two-ply | two-ply | two-ply | two-ply | two-ply | two-ply |
| | Grammage (g/m$^2$) | 25.1 | 16.5 | 15.7 | 16.3 | 18.1 | 16.4 | 19.8 |
| | Paper thickness (μm) | 125 | 115 | 110 | 135 | 110 | 85 | 120 |
| | Density (g/cm$^3$) | 0.201 | 0.143 | 0.143 | 0.121 | 0.165 | 0.193 | 0.165 |
| | Paper core | 35 | 45 | 45 | 45 | 40 | 35 | 35 |

TABLE 4-continued

| | | Commercial Product 6 | Commercial Product 7 | Commercial Product 8 | Commercial Product 9 | Commercial Product 10 | Commercial Product 11 | Commercial Product 12 |
|---|---|---|---|---|---|---|---|---|
| | inner diameter (mm) | | | | | | | |
| | Roll length (m) | 96.87 | 60.8 | 81 | 60.6 | 45.24 | 128.02 | 69.7 |
| | Outer diameter (mm) | 125.4 | 110.8 | 111.1 | 109.4 | 107.1 | 122.8 | 122.3 |
| | Roll compressibility ($m/cm^2$) | 0.855 | 0.762 | 1.009 | 0.784 | 0.589 | 1.183 | 0.65 |
| | NBKP:LBKP | — | — | — | — | — | — | — |
| | J/W ratio upon papermaking | — | — | — | — | — | — | — |
| TENSILE TEST | Longitudinal-direction dry-state tensile strength (N/m) | 71.2 | 119 | 109 | 142 | 141.6 | 162.4 | 114 |
| | Width-direction dry-state tensile strength (N/m) | 51.6 | 40 | 29 | 51 | 57.2 | 44.4 | 48 |
| | Tensile strength ratio | 1.38 | 2.98 | 3.76 | 2.78 | 2.48 | 3.66 | 2.38 |
| SENSORY EVALUATION | Tender-touch | 3.9 | 3 | 3.3 | 3 | 3.8 | 2.2 | 4.1 |
| | Bulk Softness | 3.8 | 3.1 | 2.7 | 3.1 | 3 | 2 | 3.8 |
| | Thickness feeling | 3.8 | 2.8 | 2.4 | 3.1 | 2.5 | 2.2 | 3 |
| | Emboss appearance | 2.7 | 2.4 | 2.9 | 3 | 2.2 | 2 | 3.5 |
| | Roll shape, Massiveness | 3.3 | 3 | 3.5 | 3 | 2 | 3.4 | 2.6 |

It is apparent from Table 3 and Table 4 that examples 1 and 2 according to the present invention are superior in terms of tender-touch, bulk softness, thickness feeling, appearance of embosses (remaining state of the embosses), and roll shape and massiveness, compared to comparative examples 1 and 2 and to commercial products.

(C) Finally, a preferred embodiment will be explained in detail, with reference to the accompanying drawings, in view of the above-mentioned third object, which is to provide a sanitary tissue paper for a sanitary tissue paper roll which is superior and matches human sensory evaluation, and which is highly valued in terms of such sensory evaluation. Note that a one-ply (single sheet) product is indicated as 1P, and a two-ply (double sheet) product is indicated as 2P. Further, grammage, elongation rate and tensile strength (longitudinal/lateral ratio of tension) are measurement values according to JIS. Paper thickness is measured using a dial thickness gauge "PEACOCK type-G" available from Ozaki Manufacturing Co., Ltd. under conditions of JIP P 8111. Specifically, after checking that there is no dust, dirt or such between a plunger and a measuring platform, the plunger is lowered onto the measuring platform, and a scale of the above-mentioned dial thickness gauge is moved to set a zero point. Then, the plunger is raised, a sample (tissue paper) is placed on the measuring platform, the plunger is slowly lowered, and a current gauge is read. Here, the plunger is only to be placed onto the sample. Note that measurement is performed for one sheet, and an average value for ten measurements is taken. Although a model of a characteristic-testing machine will be mentioned below, similar machines which basically adopt the same measurement principle can also be used.

The present inventors found that it is desirable to take the three characteristics below as an evaluation standard, and found that, regarding actual toilet paper rolls and/or toilet papers, ones satisfying as many of the below-defined characteristics as possible have a higher commercial value.

(1) Compression Characteristics: LC, TM, WC, and (T0–TM)

A "Handy compression tester KES-G5" available from Katotech Co., Ltd. was used for this compression-characteristic test. A paper sample is compressed between steel plates, which respectively have a circular surface with a compression area of 2 $cm^2$, at a maximum compression load of 50 $gf/cm^2$, and an evaluation is made of a compression characteristic upon returning of the paper sample. Regarding a compression characteristic thereupon shown in FIG. 7, as for the present invention, a linearity of a displacement curve between load and thickness is to be 0.2500–0.3300 for one-ply, and 0.3400–0.3700 for two-ply.

Figure 7:
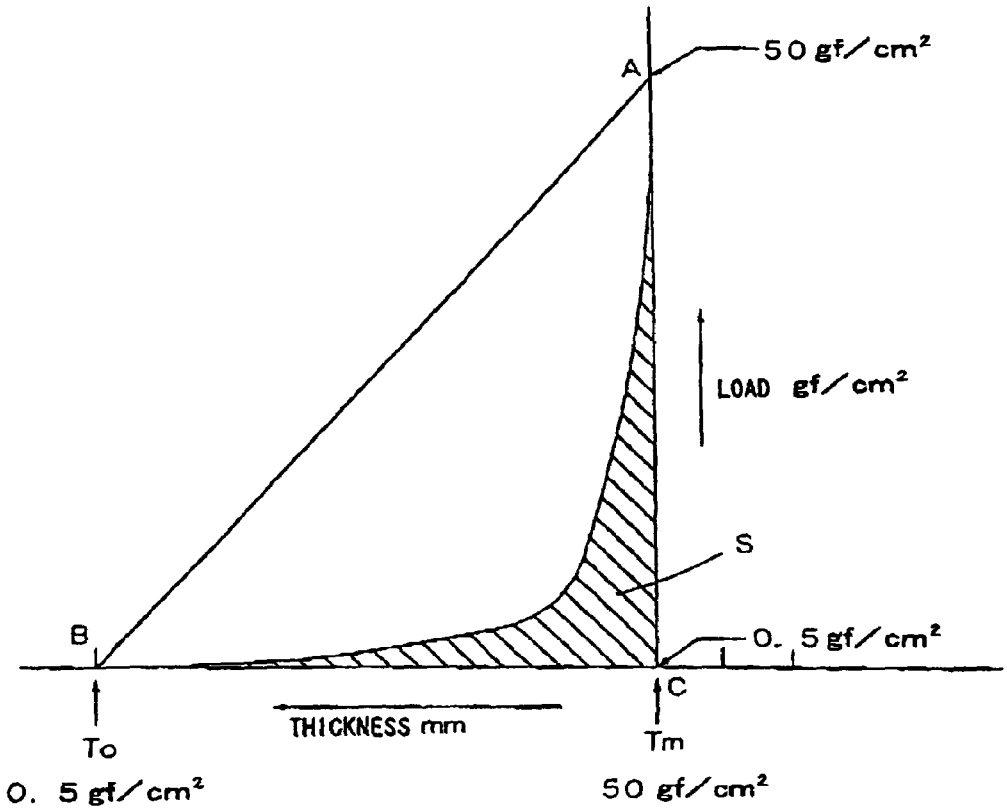
FIG. 7 is an explanation diagram of a compression-characteristic testing method of the present invention.

Here, "linearity" (compression hardness) LC indicates a ratio between diagonally-shaded area S in FIG. 7 and area of Δ ABC. LC signifies linearity of a flexible response in view of pressing depth, and the linearity is high and a value is high for hard materials. The above is a value range in which an appropriate flexible response is felt upon pushing with a hand.

Further, as for the present invention, thickness TM upon load of 50 $gf/cm^2$ is to be equal to at least 0.1400 mm for one-ply, and equal to at least 0.2500 mm for two-ply.

Note that, it is desirable that a difference (T0–TM) between thickness T0 upon load 0.5 $gf/cm^2$ and the thickness TM upon load 50 $gf/cm^2$ is equal to at least 0.2000 mm for one-ply, and equal to at least 0.2000 mm for two-ply. As T0–TM increases, a pressing depth when pressing up to 50 $gf/cm^2$ is large, and this indicates a paper quality with bulk softness. Further, it is desirable that an amount of work upon compression WC is equal to at most 0.2000 $gf*cm/cm^2$ for one-ply, and equal to at most 0.2200 $gf*cm/cm^2$ for two-ply.

(1) Bending Characteristics: B and 2HB

Figure 8:
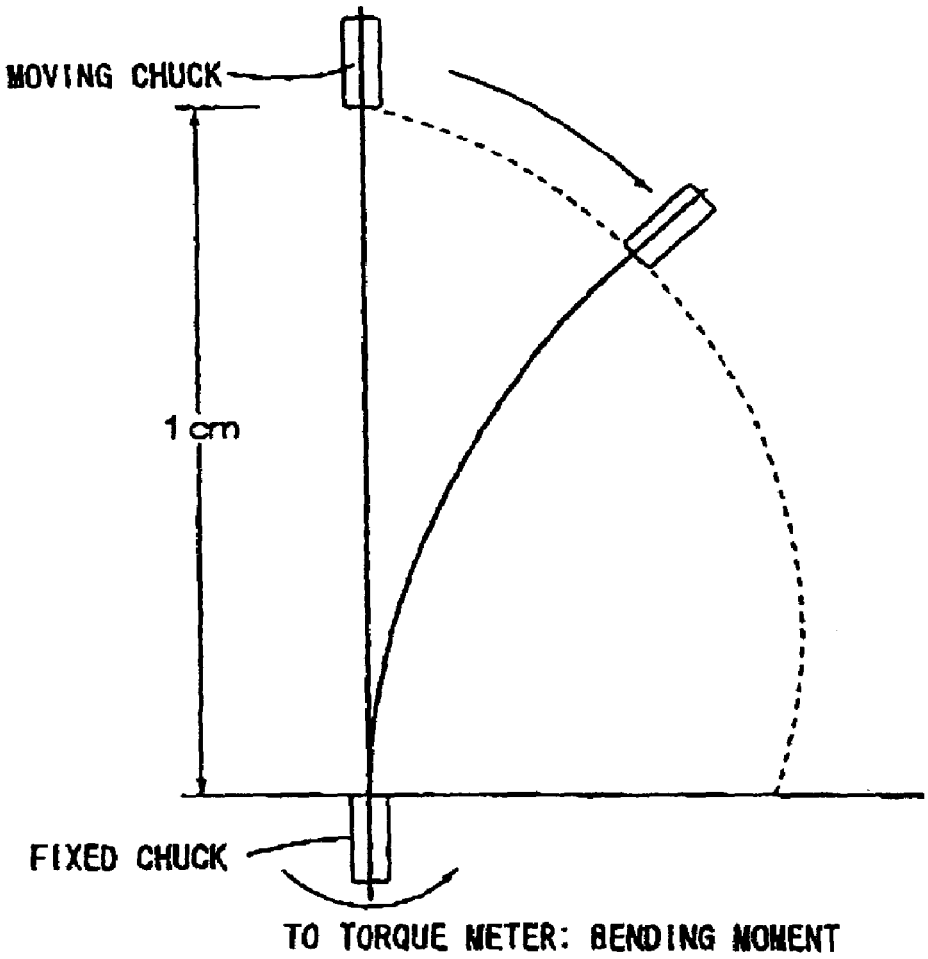
FIG. 8 is an explanation diagram of a bending-characteristic testing method of the present invention.

An "automatic, pure-bending tester KESFB2-AUTO-A" available from Katotech Co., Ltd. was used for this compression-characteristic test. As shown in FIG. 8, a paper sample having a width of 20 cm is chucked at a chuck distance of 1 cm, is bent forward up to a maximum curvature of 2.5 $cm^{-1}$ through pure bending by always keeping one side to form an arc, and is bent back to its original position. Then, the sample is bent backwardly at a maximum curvature of −2.5 $cm^{-1}$, and then is returned to the original position. A relationship between the curvature and a flexural moment during the above is evaluated.

Figure 9:
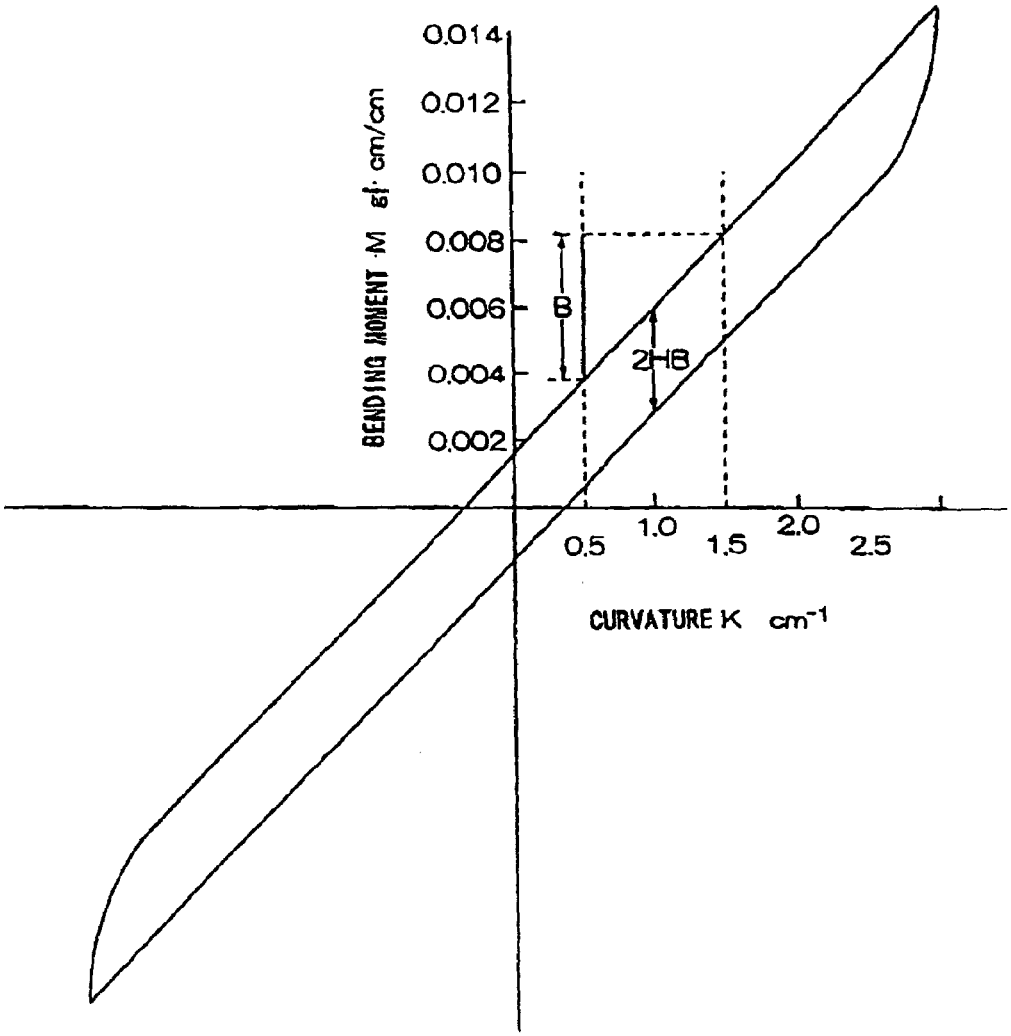
FIG. 9 is a relational diagram regarding bending characteristics.

This relationship is obtained as a value on a hysteresis curve shown in FIG. 9. A paper's bending resistance B is expressed as an average inclination between a curvature of 0.5–1.5 $cm^{-1}$, and in the present invention, an average value thereof (B average) in longitudinal and lateral directions is made to be equal to at most 0.0080 gf*cm$^2$/cm for one-ply, and equal to at most 0.0180 gf*cm$^2$/cm for two-ply. The larger the average value of bending resistance B (B average) s, the harder the sample and the more difficult it is to bend. According to a range of the present invention, resistance in bending is small.

Further, a paper's flexural recoverability (2HB) is expressed as an average hysteresis width of flexural moment between the curvature of 0.5–1.5 cm$^{-1}$, and here, an average value thereof (2HB average) in the longitudinal and lateral directions is to be 0.0030–0.0050 gf*cm/cm for one-ply, and 0.0130–0.0170 gf*cm/cm for two-ply. The larger the average value of flexural recoverability 2HB (2HB average) the lower or inferior a recoverability upon bending. The present invention defines a value range which indicates an appropriate recoverability in bending.

(3) Surface Characteristics: MMD and MIU

Figure 10:
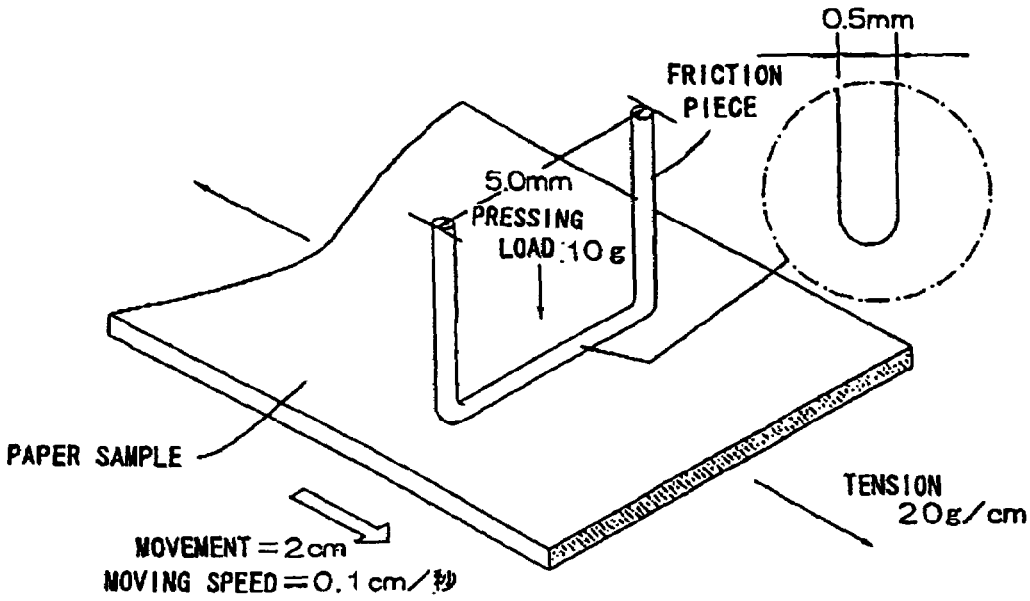
FIG. 10 is an explanation diagram of a frictional-characteristic testing method of the present invention.

A "friction sensitivity tester KESSE" available from Katotech Co., Ltd. can be used for this surface characteristic test. For this measurement, as shown in FIG. 10, a friction piece is made from a piano wire, of which a lateral section is 0.5 mm in diameter, and has a friction surface that is 5 mm long. The friction piece is made to contact a paper sample at a contact pressure of 10 gf, and is moved 2 cm at a speed of 0.1 cm/second while this paper sample is being applied with a tension of 20 gf/cm in a moving direction, and a friction coefficient thereupon is measured.

In the present invention, two values are measured: an average friction coefficient MIU which is an average value of the friction coefficient upon movement of the friction piece, and an average deviation of the friction coefficient upon this movement MMD (a value obtained by dividing an integral, which is calculated by integrating a deviation from an average value of the friction coefficient upon the above-mentioned movement across the above-mentioned movement distance (2 cm), by the above-mentioned movement distance).

In the present invention, an average value (front and back average MMD) between average deviations MMD of the above-mentioned friction coefficient obtained for longitudinal and lateral directions on a front side and that obtained for longitudinal and lateral directions on the back side for a one-ply is equal to at most 0.0320, and, an average value thereof (front average MMD) for longitudinal and lateral directions on a front side for a two-ply is equal to at most 0.0290. According to the present invention, since there is small variation in value, a smooth feeling is provided.

Further, the average value (front and back average MIU) between the paper's average friction coefficient MIU obtained for the longitudinal and lateral directions on the front side and that obtained for the longitudinal and lateral directions on the back side for a one-ply is 0.2600–0.2800, and the average value (front average MIU) of the paper's average friction coefficient for the longitudinal and lateral directions on the front side for two-ply is 0.3500–0.3800. According to the present invention, an appropriate frictional resistance is provided, and a stableness in smooth feeling is provided.

By setting measurement values of six items, (1) compression hardness, (2) thickness at maximum load, (3) bending resistance, (4) flexural recoverability, (5) surface friction coefficient, and (6) average deviation of surface friction coefficient, within a predetermined range, it is possible to reproduce quality characteristics required for a toilet paper.

The compression characteristics can be adjusted according to, for example, LBKP and NBKP mixing ratio and/or a type of pulp (coarseness of fiber, or a type or age of tree to be feedstock) of the feedstock, beating degree, reel moisture content, and/or a gap/pressure/material of a calender. It is desirable that no used-paper pulp is mixed.

The bending characteristics can be adjusted according to, for example, tensile strength, longitudinal/lateral ratio, crepe shape (rate of crepes, height difference of crepes, and such), water content rate, density, and/or adding of a paper-strengthening agent.

The surface characteristics can be adjusted according to, for example, pulp mixture, conditions of the calender, reel moisture content, angle of doctor blade tip, blade angle, balance of bond/peeling strength, and/or rate of crepes.

Regarding the above three characteristics, when one of the characteristics changes, the others will change as well. Thus, it is difficult to control these characteristics. By converting these characteristics into numerals and grasping their correlation as data indicating a change in each of these quality characteristics occurring upon change in manufacturing conditions, it becomes possible to reproduce a toilet paper quality requested by a consumer.

Below, effects of the present invention will be explained through examples.

The above-mentioned three types of characteristic tests and obtainment of six data were repeated, and correspondence with a sensory evaluation by 10 adults was researched. This sensory evaluation shows average values regarding a 1-to-4 scale evaluation regarding "thickness feeling (rich, thick feel)", "tender-touch" and "smoothness", and higher values indicate a higher rating. Further, a total evaluation shows average values regarding a similar 1-to-4 scale evaluation regarding whether or not a toilet paper is preferable considering all matters. All of the comparative examples are current commercial products.

(1) Results regarding the compression characteristics: LC, TM, WC AND (T0–TM) are shown in Table 5. Note that Table 5 also shows a total evaluation, paper-quality data, and other characteristics.

TABLE 5

| | | Compression-characteristics | | | | | | | | | | | |
|---|---|---|---|---|---|---|---|---|---|---|---|---|---|
| | | LC | TM mm | TO-TM mm | WC gf * cm/cm$^2$ | Thickness feeling | Total evaluation | Grammage g/m$^2$ | Paper thickness μm | Longitudinal tension N/m | Lateral tension N/m | Longitudinal/Lateral ratio T/Y | Softness cN |
| Toilet 1P | Present invention | 0.2500~0.3300 | >0.1400 | >0.2000 | <0.2000 | | | | | | | | |
| | Example 1 | 0.3167 | 0.1463 | 0.2213 | 0.1757 | 2.74 | 2.9 | 20.4 | 138 | 112 | 33 | 3.43 | 3.43 |
| | Comparative Example 1 | 0.3437 | 0.1383 | 0.21 | 0.1797 | 2.52 | 2.68 | 20.3 | 139 | 128 | 38 | 3.37 | 4.5 |
| | Comparative Example 3 | 3.51 | 0.1487 | 0.2613 | 0.2883 | 2.61 | 2.55 | 19.3 | 144 | 113 | 32 | 3.53 | 3.89 |

TABLE 5-continued

| | | Compression-characteristics | | | | | | | | | | | |
|---|---|---|---|---|---|---|---|---|---|---|---|---|---|
| | | LC | TM mm | TO-TM mm | WC gf * cm/cm$^2$ | Thick-ness feeling | Total evalu-ation | Grammage g/m$^2$ | Paper thick-ness μm | Longitudinal tension N/m | Lateral tension N/m | Longitudinal/Lateral ratio T/Y | Soft-ness cN |
| | Comparative Example 4 | 0.375 | 0.156 | 0.217 | 0.2013 | 2.52 | 2.26 | 20 | 147 | 114 | 33 | 3.45 | 4.04 |
| | Comparative Example 5 | 0.291 | 0.1293 | 0.2202 | 0.2347 | 2.16 | 1.9 | 20.5 | 109 | 120 | 54 | 2.22 | 4.02 |
| | Comparative Example 6 | 0.4367 | 0.1247 | 0.0933 | 0.1017 | 1.94 | 1.32 | 19.9 | 128 | 229 | 42 | 5.54 | 3.89 |
| Toilet 2P | Present invention | 0.3400~0.3700 | >0.2500 | >0.2000 | <0.2200 | | | | | | | | |
| | Example 2 | 0.3467 | 0.2635 | 0.2335 | 0.203 | 3.42 | 3.35 | 16.1 | 133 | 114 | 46 | 2.45 | 2.18 |
| | Example 3 | 0.361 | 0.2613 | 0.2303 | 0.2167 | 3.48 | 3.35 | 16.1 | 140 | 136 | 59 | 2.31 | 2.49 |
| | Comparative Example 7 | 0.388 | 0.253 | 0.2253 | 0.2153 | 3.48 | 3.45 | 16.6 | 141 | 156 | 53 | 2.96 | 2.3 |
| | Comparative Example 8 | 0.3527 | 0.2317 | 0.264 | 0.2233 | 2.97 | 2.77 | 16.4 | 137 | 140 | 49 | 2.85 | 2.41 |
| | Comparative Example 9 | 0.4587 | 0.2393 | 0.2767 | 0.3163 | 2.77 | 2.48 | 15.5 | 137 | 125 | 42 | 2.97 | 2.75 |
| | Comparative Example 10 | 0.5613 | 0.3263 | 0.3314 | 0.465 | 2.55 | 2.19 | 15.4 | 136 | 112 | 33 | 3.39 | 2.74 |
| | Comparative Example 11 | 0.348 | 0.206 | 0.3143 | 0.2727 | 3.1 | 2.68 | 16.6 | 113 | 130 | 41 | 3.17 | 2.46 |
| | Comparative Example 12 | 0.2237 | 0.1867 | 0.382 | 0.2133 | 3.1 | 3.19 | 15.4 | 110 | 95 | 24 | 4.02 | 1.75 |
| | Comparative Example 13 | 0.4763 | 0.2407 | 0.3166 | 0.3747 | 1.9 | 1.35 | 16.8 | 138 | 245 | 84 | 2.91 | 3.79 |

(2) Results regarding bending characteristics: B and 2HB are shown in Table 6.

(3) Results regarding surface characteristics: MMD and MIU are shown in Table 7 and Table 8.

TABLE 6

| | | Bending-characteristics | | | | | | |
|---|---|---|---|---|---|---|---|---|
| | | Longitudinal | | Lateral | | Average | | |
| | | B gf * cm$^2$/cm | 2HB gf * cm/cm | B gf * cm$^2$/cm | 2HB gf * cm/cm | B gf * cm$^2$/cm | 2HB gf * cm/cm | Tender touch |
| Toilet 1P | Present invention | | | | | <0.0080 | 0.0030~0.0050 | |
| | Example 1 | 0.0086 | 0.005 | 0.0066 | 0.0035 | 0.0076 | 0.0043 | 3.13 |
| | Comparative Example 1 | 0.0094 | 0.0047 | 0.0078 | 0.0039 | 0.0086 | 0.0043 | 2.74 |
| | Comparative Example 2 | 0.0119 | 0.008 | 0.0083 | 0.0056 | 0.0101 | 0.0068 | 2.52 |
| | Comparative Example 3 | 0.0106 | 0.0067 | 0.0066 | 0.0045 | 0.0086 | 0.0056 | 2.45 |
| | Comparative Example 4 | 0.0117 | 0.0078 | 0.0112 | 0.0047 | 0.0115 | 0.0063 | 1.97 |
| | Comparative Example 5 | 0.0099 | 0.0073 | 0.0085 | 0.0043 | 0.0092 | 0.0058 | 1.71 |
| Toilet 2P | Present invention | | | | | <0.0180 | 0.0130~0.0170 | |
| | Example 2 | 0.02 | 0.0203 | 0.0138 | 0.0111 | 0.0169 | 0.0157 | 3.61 |
| | Example 3 | 0.0184 | 0.0206 | 0.0133 | 0.0108 | 0.0159 | 0.0157 | 3.61 |
| | Comparative Example 6 | 0.0202 | 0.022 | 0.0146 | 0.0121 | 0.0174 | 0.0171 | 3.45 |
| | Comparative Example 7 | 0.0246 | 0.02 | 0.0153 | 0.0123 | 0.2 | 0.0162 | 2.94 |
| | Comparative Example 8 | 0.0215 | 0.0177 | 0.019 | 0.0134 | 0.0203 | 0.0156 | 2.74 |
| | Comparative Example 9 | 0.0244 | 0.019 | 0.0189 | 0.0265 | 0.0217 | 0.0228 | 2.39 |
| | Comparative Example 10 | 0.0245 | 0.02 | 0.0223 | 0.0179 | 0.0234 | 0.019 | 2.97 |
| | Comparative Example 11 | 0.0114 | 0.0085 | 0.0192 | 0.0135 | 0.0153 | 0.011 | 3.39 |
| | Comparative Example 12 | 0.0321 | 0.0339 | 0.0322 | 0.0316 | 0.0322 | 0.0328 | 1.48 |

TABLE 7

| | | Surface-characteristics | | | | | | | |
|---|---|---|---|---|---|---|---|---|---|
| | | Front | | | Back | | | | |
| | | MMD front longitudinal | MMD front lateral | MMD front average | MMD back longitudinal | MMD back lateral | MMD back average | MMD average | Smoothness |
| Toilet 1P | Present invention | | | | | | | <0.032 | |
| | Example 1 | 0.033 | 0.026 | 0.0295 | 0.0346 | 0.03 | 0.0323 | 0.0309 | 3.23 |
| | Comparative Example 1 | 0.0366 | 0.0283 | 0.0325 | 0.0357 | 0.0305 | 0.0331 | 0.0328 | 2.71 |
| | Comparative Example 3 | 0.0383 | 0.0257 | 0.032 | 0.036 | 0.0293 | 0.0327 | 0.0323 | 2.58 |
| | Comparative Example 4 | 0.0404 | 0.0235 | 0.032 | 0.041 | 0.0293 | 0.0352 | 0.0336 | 2.32 |
| | Comparative Example 5 | 0.043 | 0.027 | 0.035 | 0.0424 | 0.0266 | 0.0345 | 0.0348 | 2.06 |
| | Comparative Example 6 | 0.0446 | 0.0321 | 0.0384 | 0.054 | 0.0373 | 0.0457 | 0.042 | 1.61 |
| Toilet 2P | Present invention | | | <0.029 | | | | | |
| | Example 2 | 0.0318 | 0.0252 | 0.0285 | | | | | 3.61 |
| | Example 3 | 0.0282 | 0.0212 | 0.0247 | | | | | 3.61 |
| | Comparative Example 7 | 0.033 | 0.0261 | 0.0296 | | | | | 2.52 |
| | Comparative Example 8 | 0.0331 | 0.0254 | 0.0293 | | | | | 3 |
| | Comparative Example 9 | 0.0283 | 0.0213 | 0.0248 | | | | | 2.81 |
| | Comparative Example 10 | 0.0274 | 0.0268 | 0.0271 | | | | | 2.26 |
| | Comparative Example 11 | 0.0289 | 0.0254 | 0.0272 | | | | | 3.1 |
| | Comparative Example 12 | 0.0245 | 0.0185 | 0.0215 | | | | | 3.68 |
| | Comparative Example 13 | 0.0439 | 0.0284 | 0.0362 | | | | | 1.45 |

TABLE 8

| | | Surface-characteristics | | | | | | | |
|---|---|---|---|---|---|---|---|---|---|
| | | Front | | | Back | | | | |
| | | MIU front longitudinal | MIU front lateral | MIU front average | MIU back longitudinal | MIU back lateral | MIU back average | MIU Average | Smoothness |
| Toilet 1P | Present invention | | | | | | | 0.3500~0.3800 | |
| | Example 1 | 0.285 | 0.2503 | 0.2677 | 0.2923 | 0.03 | 0.2597 | 0.2718 | 0.29 |
| | Comparative Example 1 | 0.2773 | 0.2677 | 0.2725 | 0.2897 | 0.0305 | 0.2563 | 0.2728 | 2.68 |
| | Comparative Example 3 | 0.3003 | 0.292 | 0.2962 | 0.292 | 0.0293 | 0.267 | 0.2878 | 2.55 |
| | Comparative Example 4 | 0.314 | 0.2903 | 0.3022 | 0.2957 | 0.0293 | 0.2627 | 0.2907 | 2.26 |
| | Comparative Example 5 | 0.259 | 0.244 | 0.2515 | 0.2523 | 0.0266 | 0.2303 | 0.2464 | 1.9 |
| | Comparative Example 6 | 0.2597 | 0.232 | 0.2459 | 0.2553 | 0.0373 | 0.2383 | 0.2463 | 1.32 |
| Toilet 2P | Present invention | | | 0.3500~0.3800 | | | | | |
| | Example 2 | 0.4123 | 0.3135 | 0.3629 | | | | | 3.61 |
| | Example 3 | 0.389 | 0.3307 | 0.3599 | | | | | 3.71 |
| | Comparative Example 7 | 0.3607 | 0.3513 | 0.356 | | | | | 2.52 |
| | Comparative Example 8 | 0.3257 | 0.2973 | 0.3115 | | | | | 3 |
| | Comparative Example 9 | 0.4063 | 0.372 | 0.3892 | | | | | 2.81 |
| | Comparative Example 10 | 0.4353 | 0.41 | 0.4227 | | | | | 2.26 |
| | Comparative Example 11 | 0.2947 | 0.3003 | 0.2975 | | | | | 3.1 |

TABLE 8-continued

| | Surface-characteristics | | | | | | | |
|---|---|---|---|---|---|---|---|---|
| | Front | | | Back | | | | |
| | MIU front longitudinal | MIU front lateral | MIU front average | MIU back longitudinal | MIU back lateral | MIU back average | MIU Average | Smoothness |
| Comparative Example 12 | 0.331 | 0.3393 | 0.3352 | | | | | 3.28 |
| Comparative Example 13 | 0.335 | 0.3107 | 0.3229 | | | | | 1.45 |

From the results above, it is appreciated that the present examples are superior in all of "bulk softness and thickness feeling", "tender-touch" and "smoothness."

INDUSTRIAL APPLICABILITY

As explained above, according to the present invention, the above-mentioned difference in pressing depth of a sanitary tissue paper roll is set to be 2.5–3.5 mm for a two-ply or a three-ply roll, and 1.5–2.5 mm for a one-ply roll. Therefore, it is possible to provide an appropriate soft feeling to a consumer who has taken the roll and stimulate his/her will to purchase this product, and thus, increase sales.

Further, since it is possible to control roll hardness of a sanitary tissue paper roll within an appropriate range, it is possible to supply, to the market, sanitary tissue paper rolls which have an appropriate tender-touch feeling.

Further, since a sanitary tissue paper roll can be provided with both an appropriate shape-maintaining ability and tender-touch feel, it is superior not only in terms of feel but also appearance. Therefore, it will be possible to appeal to a consumer's sense of beauty and stimulate his/her will to purchase this product, and thus, increase sales.

Further, since it is possible to easily set a difference in pressing depth within an appropriate range while appropriately securing a roll-shape-maintaining ability, manufacturing of a sanitary tissue paper roll according to the present invention is facilitated.

According to the present invention, a sanitary tissue paper roll will be rich in thickness feeling and bulk softness while being difficult to deform, and will have a sufficient massiveness when taken in a hand, and, embosses will not easily be flattened in case embossing is applied.

According to the present invention, it is possible to provide a sanitary tissue paper which is superior and matches a human sensory evaluation, and which is highly valued in such sensory evaluation.

Further, by using three basic measurement methods and six measurement data in combination, it is possible to quantify bulk softness, pliantness and smoothness of a toilet paper, which is one kind of sanitary tissue paper, and manage and control a quality of the toilet paper according to these measurement data.

The invention claimed is:

1. A sanitary tissue paper for a sanitary tissue paper roll, comprising:

one of a one-ply paper and a two-ply paper, wherein said one-ply paper has characteristics such that (i) upon subjecting a sample of said one-ply paper to a compression load of at most 50 gf/cm$^2$ between circular compression surfaces of steel plates, with each of the circular compression surfaces having an area of 2 cm$^2$, and then relieving the sample of the compression load so as to allow the sample to return to an original condition, a linearity of a displacement curve between the compression load and a thickness of the sample is 0.25–0.33, and (ii) while subjecting the sample of said one-ply paper to a compression load of 50 gf/cm$^2$ between the circular compression surfaces, a thickness of the sample is at least 0.14 mm, and wherein said two-ply paper has characteristics such that (i) upon subjecting a sample of said two-ply paper to a compression load of at most 50 gf/cm$^2$ between circular compression surfaces of steel plates, with each of the circular compression surfaces having an area of 2 cm$^2$, and then relieving the sample of the compression load so as to allow the sample to return to an original condition, a linearity of a displacement curve between the compression load and a thickness of the sample is 0.34–0.37, and (ii) while subjecting the sample of said two-ply paper to a compression load of 50 gf/cm$^2$ between the circular compression surfaces, a thickness of the sample is at least 0.25 mm.

2. The sanitary tissue paper according to claim 1, wherein said one-ply paper has characteristics such that (i) while a sample of said one-ply paper is subjected to a compression load of 0.5 gf/cm$^2$ between the circular compression surfaces the sample has a first thickness, and while the sample of said one-ply paper is subjected to a compression load of 50 gf/cm$^2$ between the circular compression surfaces the sample has a second thickness, with a difference between the first thickness and the second thickness being at least 0.20 mm, and (ii) an amount of work upon compression of the sample of said one-ply paper between the circular compression surfaces is at most 0.2000 gf·cm/cm$^2$, and said two-ply paper has characteristics such that (i) while a sample of said two-ply paper is subjected to a compression load of 0.5 gf/cm$^2$ between the circular compression surfaces the sample has a first thickness, and while the sample of said two-ply paper is subjected to a compression load of 50 gf/cm$^2$ between the circular compression surfaces the sample has a second thickness, with a difference between the first thickness and the second thickness being at least 0.20 mm, and (ii) an amount of work upon compression of the sample of said two-ply paper between the circular compression surfaces is at most 0.22 gf·cm/cm$^2$.

3. The sanitary tissue paper according to claim 2, wherein said one-ply paper has characteristics such that when a sample of said one-ply paper having a width of 20 cm is (i) chucked at a chuck a chuck distance of 1 cm, then (ii) bent forward up to a maximum curvature of 2.5 $cm^{-1}$ through pure bending by maintaining one side of the sample in the shape of an arc, then (iii) bent back to an original position, then (iv) bent backward at a maximum curvature of −2.5 $cm^{-1}$, and then (v) returned to the original position, a relationship between curvature and a flexural moment exhibited by the sample demonstrates (1) said one-ply paper to have an average bending resistance in longitudinal and lateral directions of at most 0.008 gf·$cm^2$/cm, with the bending resistance being expressed as an average inclination between a curvature of 0.5–1.5 $cm^{-1}$, and (2) said one-ply paper to have an average flexural recoverability in the longitudinal and lateral directions of 0.003–0.005 gf·cm/cm, with the flexural recoverability being expressed as an average hysteresis width of a flexural moment between a curavature of 0.5–1.5 $cm^{-1}$, and said two-ply paper has characteristics such that when a sample of said two-ply paper having a width of 20 cm is (i) chucked at a chuck a chuck distance of 1 cm, then (ii) bent forward up to a maximum curvature of 2.5 $cm^{-1}$ through pure bending by maintaining one side of the sample in the shape of an arc, then (iii) bent back to an original position, then (iv) bent backward at a maximum curvature of −2.5 $cm^{-1}$, and then (v) returned to the original position, a relationship between curvature and a flexural moment exhibited by the sample demonstrates (1) said two-ply paper to have an average bending resistance in longitudinal and lateral directions of at most 0.018 gf·$cm^2$/cm, with the bending resistance being expressed as an average inclination between a curvature of 0.5–1.5 $cm^{-1}$, and (2) said two-ply paper to have an average flexural recoverability in the longitudinal and lateral directions of 0.013–0.017 gf·cm/cm, with the flexural recoverability being expressed as an average hysteresis width of a flexural moment between a curavature of 0.5–1.5 $cm^{-1}$.

4. The sanitary tissue paper according to claim 3, wherein said one-ply paper has characteristics such that (i) an average value between an average friction coefficient of said one-ply paper for longitudinal and lateral directions on a front side of said one-ply paper and an average value between an average friction coefficient of said one-ply paper for longitudinal and lateral directions on a back side of said one-ply paper is 0.260–0.280, and (ii) an average value between an average deviation of a friction coefficient for longitudinal and lateral directions on the front side of said one-ply paper and an average deviation of a friction coefficient for longitudinal and lateral directions on the back side of said one-ply paper is at most 0.032, with the friction coefficient for the longitudinal and lateral directions on the front side being obtained by (i) contacting a friction piece, made from a piano wire, having a diameter of 0.5 mm and length of 5 mm with a front side of a sample of said one-ply paper along the length of the friction piece at a contact pressure of 10 gf, and then (ii) moving the friction piece at a speed of 0.1 cm/second in a direction orthogonal to a length direction of the friction piece while a tension of 20 gf/cm is applied to the sample in a moving direction of the friction piece, and with the average deviation of the friction coefficient for the longitudinal and lateral directions on the back side being obtained by (i) contacting the friction piece with a back side of the sample of said one-ply paper along the length of the friction piece at a contact pressure of 10 gf, and then (ii) moving the friction piece at a speed of 0.1 cm/second in a direction orthogonal to a length direction of the friction piece while a tension of 20 gf/cm is applied to the sample in a moving direction of the friction piece, and said two-ply paper has characteristics such that (i) an average value between an average friction coefficient of said two-ply paper for longitudinal and lateral directions on a front side of said two-ply paper and an average value between an average friction coefficient of said two-ply paper for longitudinal and lateral directions on a back side of said two-ply paper is 0.350–0.380, and (ii) an average value between an average deviation of a friction coefficient for longitudinal and lateral directions on the front side of said two-ply paper and an average deviation of a friction coefficient for longitudinal and lateral directions on the back side of said two-ply paper is at most 0.029, with the friction coefficient for the longitudinal and lateral directions on the front side being obtained by (i) contacting a friction piece, made from a piano wire, having a diameter of 0.5 mm and length of 5 mm with a front side of a sample of said two-ply paper along the length of the friction piece at a contact pressure of 10 gf, and then (ii) moving the friction piece at a speed of 0.1 cm/second in a direction orthogonal to a length direction of the friction piece while a tension of 20 gf/cm is applied to the sample in a moving direction of the friction piece, and with the average deviation of the friction coefficient for the longitudinal and lateral directions on the back side being obtained by (i) contacting the friction piece with a back side of the sample of said two-ply paper along the length of the friction piece at a contact pressure of 10 gf, and then (ii) moving the friction piece at a speed of 0.1 cm/second in a direction orthogonal to a length direction of the friction piece while a tension of 20 gf/cm is applied to the sample in a moving direction of the friction piece.

5. The sanitary tissue paper according to claim 4, wherein said one-ply paper and said two-ply paper each have (i) grammage of 15–25 g/$m^2$, (ii) a thickness of 120–180 μm, (iii) a longitudinal/lateral ratio of tension of 2.0–3.0, (iv) an elongation rate in a longitudinal direction of 20–35%, (v) a longitudinal tensile strength of 110–115 N/m, and
(vi) 30–50 crepes per cm.

6. A sanitary tissue paper roll comprising a roll of the two-ply paper according to claim 4, wherein said roll, and a difference in depths resulting from pressing at the respective pressing pressures is continuously measured nine times, a difference between a maximum and a minimum of these nine differences in depth is within a range of 0.5–1.0 mm.

7. The sanitary tissue paper roll according to claim 6, wherein said roll of the two-ply paper has characteristics such that when a difference in depths resulting from pressing at the respective pressures is continuously measured nine times, each of these nine differences in depth is within the range of 2.5–3.5 mm, and a difference between a maximum and a minimum of these nine differences in depth is within a range of 0.5–1.0 mm.

8. A sanitary tissue paper roll comprising a roll of the one-ply paper according to claim 4, wherein said roll of the one-ply paper has characteristics such that when said roll is on a horizontal surface, with a central axis of said roll horizontally oriented, and a circular plate indenter having an area of 2 $cm^2$ is vertically pressed, at least at respective pressing pressures of 0.5 $gf/cm^2$ and 50 $gf/cm^2$, against a central portion of an upper surface of an outer periphery of said roll, a difference in depths resulting from pressing at the respective pressing pressures is within a range of 1.5–2.5 mm.

9. A sanitary tissue paper roll comprising a roll of the sanitary tissue paper according to claim 4, wherein said roll of the sanitary tissue paper has characteristics such that when said roll is on a horizontal surface, with a central axis of said roll horizontally oriented, and a circular plate indenter having an area of 2 $cm^2$ is vertically pressed, at least at respective pressing pressures of 0.5 $gf/cm^2$ and 50 $gf/cm^2$, against a central portion of an upper surface of an outer periphery of with each of said sheets having a grammage of 15–25 $g/m^2$, a density of 0.10–0.15 $g/cm^3$, and a thickness of 20–170 μm.

10. A sanitary tissue paper roll comprising a roll of the sanitary tissue paper according to claim 4, wherein an elongation rate said sanitary tissue paper in a longitudinal direction of said sanitary tissue paper is 20–35%.

11. A sanitary tissue paper roll comprising a roll of the sanitary tissue paper according to claim 4, wherein said roll is formed by winding said sanitary tissue paper such that a roll compressibility of said roll is 0.68–0.74 $m/cm^2$, with said roll compressibility being defined as a value obtained by dividing a length of said roll by a cross section of said roll.

12. The sanitary tissue paper roll according to claim 11, wherein said roll of the sanitary tissue paper comprises wound sheets of said sanitary tissue paper, with said sanitary tissue paper having characteristics such that a dry-state tensile strength, which is measured according to a tensile-characteristic testing method defined by JISP8113, for each of said sheets is at least 40 N/m in a width direction, and is 1–4 folds of the width direction in a longitudinal direction.

13. The sanitary tissue paper roll according to claim 11, wherein a number of crepes per cm of said sanitary tissue paper is 25–45 per cm, and an elongation rate of said sanitary tissue paper in a longitudinal direction is 15–25%.

14. The sanitary tissue paper roll according to claim 11, wherein said roll of the sanitary tissue paper comprises wound sheets of said sanitary tissue paper, said roll of the two-ply paper has characteristics such that when said roll is on a horizontal surface, with a central axis of said roll horizontally oriented, and a circular plate indenter having an area of 2 $cm^2$ is vertically pressed, at least at respective pressing pressures of 0.5 $gf/cm^2$ and 50 $gf/cm^2$, against a central portion of an upper surface of an outer periphery of said roll, a difference in depths resulting from pressing at the respective pressing pressures is within a range of 2.5–3.5 mm.

15. The sanitary tissue paper roll according to claim 11, wherein said sanitary tissue paper comprises a paper made mainly of Nadelholz bleached kraft pulp and Laubholz bleached kraft pulp and having a weight proportion of Nadelholz bleached kraft pulp to Laubholz bleached kraft pulp of 10:90–70:30.

16. The sanitary tissue paper roll according to claim 11, wherein said sanitary tissue paper is embossed prior to winding said sanitary tissue paper to form said roll.

17. The sanitary tissue paper roll according to claim 11, wherein when said roll is formed by winding said one-ply paper, a roll length is 58–65 m, and when said roll is formed by winding said two-ply paper, a roll length is 29–33 m.

18. The sanitary tissue paper roll according to claim 11, wherein said roll is formed made by winding said sanitary tissue paper around a core having an outer diameter of 30–40 mm.

19. A sanitary tissue paper for a sanitary tissue paper roll, comprising:

one of a one-ply paper and a two-ply paper, wherein said one-ply paper has characteristics such that when a sample of said one-ply paper having a width of 20 cm is (i) chucked at a chuck a chuck distance of 1 cm, then (ii) bent forward up to a maximum curvature of 2.5 $cm^{-1}$ through pure bending by maintaining one side of the sample in the shape of an arc, then (iii) bent back to an original position, then (iv) bent backward at a maximum curvature of −2.5 $cm^{-1}$, and then (v) returned to the original position, a relationship between curvature and a flexural moment exhibited by the sample demonstrates (1) said one-ply paper to have an average bending resistance in longitudinal and lateral directions of at most 0.008 $gf \cdot cm^2/cm$, with the bending resistance being expressed as an average inclination between a curvature of 0.5–1.5 $cm^{-1}$, and (2) said one-ply paper to have an average flexural recoverability in the longitudinal and lateral directions of 0.003–0.005 gf·cm/cm, with the flexural recoverability being expressed as an average hysteresis width of a flexural moment between a curavature of 0.5–1.5 $cm^{-1}$, and wherein said two-ply paper has characteristics such that when a sample of said two-ply paper having a width of 20 cm is (i) chucked at a chuck a chuck distance of 1 cm, then (ii) bent forward up to a maximum curvature of 2.5 $cm^{-1}$ through pure bending by maintaining one side of the sample in the shape of an arc, then (iii) bent back to an original position, then (iv) bent backward at a maximum curvature of −2.5 $cm^{-1}$, and then (v) returned to the original position, a relationship between curvature and a flexural moment exhibited by the sample demonstrates (1) said two-ply paper to have an average bending resistance in longitudinal and lateral directions of at most 0.018 gf·$cm^2$/cm, with the bending resistance being expressed as an average inclination between a curvature of 0.5–1.5 $cm^{-1}$, and (2) said two-ply paper to have an average flexural recoverability in the longitudinal and lateral directions of 0.013–0.017 gf·cm/cm, with the flexural recoverability being expressed as an average hysteresis width of a flexural moment between a curavature of 0.5–1.5 $cm^{-1}$.

20. A sanitary tissue paper for a sanitary tissue paper roll, comprising:

one of a one-ply paper and a two-ply paper, wherein said one-ply paper has characteristics such that (i) an average value between an average friction coefficient of said one-ply paper for longitudinal and lateral directions on a front side of said one-ply paper and an average value between an average friction coefficient of said one-ply paper for longitudinal and lateral directions on a back side of said one-ply paper is 0.260–0.280, and (ii) an average value between an average deviation of a friction coefficient for longitudinal and lateral directions on the front side of said one-ply paper and an average deviation of a friction coefficient for longitudinal and lateral directions on the back side of said one-ply paper is at most 0.032, with the friction coefficient for the longitudinal and lateral directions on the front side being obtained by (i) contacting a friction piece, made from a piano wire, having a diameter of 0.5 mm and length of 5 mm with a front side of a sample of said one-ply paper along the length of the friction piece at a contact pressure of 10 gf, and then (ii) moving the friction piece at a speed of 0.1 cm/second in a direction orthogonal to a length direction of the friction piece while a tension of 20 gf/cm is applied to the sample in a moving direction of the friction piece, and with the average deviation of the friction coefficient for the longitudinal and lateral directions on the back side being obtained by (i) contacting the friction piece with a back side of the sample of said one-ply paper along the length of the friction piece at a contact pressure of 10 gf, and then (ii) moving the friction piece at a speed of 0.1 cm/second in a direction orthogonal to a length direction of the friction piece while a tension of 20 gf/cm is applied to the sample in a moving direction of the friction piece, and wherein said two-ply paper has characteristics such that (i) an average value between an average friction coefficient of said two-ply paper for longitudinal and lateral directions on a front side of said two-ply paper and an average value between an average friction coefficient of said two-ply paper for longitudinal and lateral directions on a back side of said two-ply paper is 0.350–0.380, and (ii) an average value between an average deviation of a friction coefficient for longitudinal and lateral directions on the front side of said two-ply paper and an average deviation of a friction coefficient for longitudinal and lateral directions on the back side of said two-ply paper is at most 0.029, with the friction coefficient for the longitudinal and lateral directions on the front side being obtained by (i) contacting a friction piece, made from a piano wire, having a diameter of 0.5 mm and length of 5 mm with a front side of a sample of said two-ply paper along the length of the friction piece at a contact pressure of 10 gf, and then (ii) moving the friction piece at a speed of 0.1 cm/second in a direction orthogonal to a length direction of the friction piece while a tension of 20 gf/cm is applied to the sample in a moving direction of the friction piece, and with the average deviation of the friction coefficient for the longitudinal and lateral directions on the back side being obtained by (i) contacting the friction piece with a back side of the sample of said two-ply paper along the length of the friction piece at a contact pressure of 10 gf, and then (ii) moving the friction piece at a speed of 0.1 cm/second in a direction orthogonal to a length direction of the friction piece while a tension of 20 gf/cm is applied to the sample in a moving direction of the friction piece.

* * * * *